US005502954A

United States Patent [19]

Akiyama et al.

[11] Patent Number: 5,502,954

[45] Date of Patent: Apr. 2, 1996

[54] FLAP FOLDING DEVICE OF WRAPPING MACHINE

[75] Inventors: Heiemon Akiyama, Chiba; Masafumi Hamaguchi, Ibaraki; Minoru Sato; Hiroaki Kikuta, both of Chiba, all of Japan

[73] Assignee: Tokyo Automatic Machinery Works, Ltd., Tokyo, Japan

[21] Appl. No.: 181,238

[22] Filed: Jan. 13, 1994

[30] Foreign Application Priority Data

| | | | |
|---|---|---|---|
| Jul. 21, 1993 | [JP] | Japan | 5-180442 |
| Jul. 21, 1993 | [JP] | Japan | 5-180443 |
| Sep. 30, 1993 | [JP] | Japan | 5-245192 |

[51] Int. Cl.[6] ..... B65B 11/22

[52] U.S. Cl. ..... 53/504; 53/76; 53/230

[58] Field of Search ..... 53/230, 232, 231, 53/504, 52, 76, 75, 376.4, 372.4, 378.3, 376.3

[56] References Cited

U.S. PATENT DOCUMENTS

| | | | |
|---|---|---|---|
| 874,620 | 12/1907 | Patterson | 53/231 |
| 2,153,483 | 4/1939 | Rose | 53/231 |
| 2,739,431 | 3/1956 | Griswold et al. | 53/231 |
| 3,006,119 | 10/1961 | Fingerhut . | |
| 3,763,629 | 10/1973 | Carlstrom et al. | 53/230 X |
| 4,023,330 | 5/1977 | Williams | 53/378 |
| 4,313,290 | 2/1982 | Furuya et al. | 53/230 |

FOREIGN PATENT DOCUMENTS

| | | |
|---|---|---|
| 2-23305 | 2/1990 | Japan . |
| 3-14685 | 2/1991 | Japan . |
| 3-32004 | 3/1991 | Japan . |

*Primary Examiner*—James F. Coan
*Attorney, Agent, or Firm*—Sandler, Greenblum & Bernstein

[57] ABSTRACT

Flap folding device of a wrapping machine. Side folding guides approach side flaps to hit a hitting part against the closed side faces of a wrapped body part of a content or volume, thereby pressing a wrapped body part, near the base end of the side flaps that face the closed side faces, against the closed side faces. Subsequently, the middle part of each of the side folding guides makes a quarter turn while tracing a corner continued to the closed side faces,. Therefore, the base ends of the side flaps are folded along the corners while being pulled toward the forward end thereof, and, at the same time, are pressed by folding parts against the open sides, through the entire length, from the base end to the forward end, of the side flaps.

15 Claims, 16 Drawing Sheets

INPUT MEANS
COMPUTING MEANS
COMPARISON MEANS
CONTROL MEANS
9
10
4
4a
2c
2d
2
1
1a
1b
1c
A
A1
B
B1
C1
C2
3
F
L
SL
W

B
A2
A3
B1
C2
3
4
4b
5
5a
B4
A4
2
B5

B
B1
A3
A2
C2
3
3b
6
B4
A4
4
5
2

FLAP FOLDING DEVICE OF WRAPPING MACHINE

BACKGROUND OF THE INVENTION

The present invention relates to a flap folding device of a wrapping machine for over-wrapping, with a wrapping sheet like kraft paper, an approximately rectangular content such as a stack of paper or a number of books, or belt-like cloth or textile folded longitudinally in a staggered form, or a stack of a number of boxes and, more particularly, to a flap folding device in which a pair of side-folding guides are arranged on the same plane as the open side of an approximately rectangular content whose body portion has been wrapped with the wrapping sheet in a tubular form, and move into contact with, and away from, both side flaps at each protruding end of the wrapping sheet projecting in a square cylindrical form from the open side; as the side-folding guides contact the side flaps, the side flaps are folded inward along the open side of the content, and subsequently remaining lower and upper flaps at each protruding end are folded in order along the open side of the content.

As this type of flap folding device of a wrapping machine, there has been known such a device that, as disclosed in Japanese Utility Model Laid-Open No. Hei 3-32004, projections are provided facing the vicinity of the upper and lower ends of each side flap by forming each side-folding guide a little smaller in a vertical size than that of the content to be wrapped. These side-folding guides approach both side flaps, where the upper and lower projections hit against the vicinity of the upper and lower ends of each side flap and then move horizontally along the open side of the content to be wrapped, thereby pushing the upper and lower ends of the side flaps straight from the base end to the forward end. Then, each side flap is folded at a right angle at the base end until the whole part of the side flap will be flat against the open side, and at the same time, the lower flap and the upper flap are added with a horizontal folding line while being folded obliquely at 45 degrees at both side ends; and subsequently the lower flap and the upper flap are protruded out horizontally through a clearance formed vertically in the side-folding guide.

Furthermore, as disclosed in Japanese Utility Model Laid-Open No. Hei 2-23305, each side-folding guide is composed of a pair of upper and lower plates, which are horizontally rotatably installed such that a clearance between the upper and lower plates will be adjustable in accordance with a change in the vertical size of the content; these side-folding guides rotate nearly simultaneously until they hit against the vicinity of the upper and lower ends of both side flaps. Thereafter, the side-folding guides are horizontally moved along the open side of the content, pushing the upper and lower ends of both side flaps as in a straight state from the base end to the forward end while folding each side flap at the base end at a right angle until the whole part of the side flap is flat against the open side. At the same time, the lower flap and the upper flap are folded at both side ends, at 45 degrees, to produce a horizontal folding line, thus being protruded out horizontally.

Furthermore, as disclosed in for example Japanese Patent Publication No. Hei 3-14685, with a content placed on a wrapping sheet which has been fed on an elevator, a switch is manually operated to thereby lower the elevator to fold up the wrapping sheet in a nearly U shape. Thereafter, the wrapping sheet is horizontally transferred by a transfer means from the elevator to a discharge table, where both ends of the folded wrapping sheet are lapped over the upper surface of the content, thus finishing the body wrapping process. At the same time, the side flap positioned on the upstream side in the direction of transfer of each protruded end is folded, by the side-folding guide connected by the transfer means, along the open side of the content, and then the side flap positioned on the downstream is folded along the open side of the content by a fixed side-folding guide. Thereafter, the upper flap is folded down along the open side and at the same time an adhesive tape fed out by a tape feeding mechanism is attached by a taping mechanism on both overlapped ends of the wrapping sheet to close these overlapped ends. Subsequently, after the upward folding of the lower flap along the outer side of the upper flap that has been folded, the forward end of the lower flap which has been overlapped on the extreme outer side by the inward protruding motion of the guide is folded along the upper surface of the content, and then the adhesive tape fed out by the tape feeding mechanism is affixed on the forward end of the lower flap and on the upper surface of the content to seal them.

These prior-art flap folding devices of the wrapping machine described above, however, have such a problem that the side-folding guide simply moves horizontally along the open side of the content to be wrapped, to push to fold the upper and lower ends of the side flap as in a straight state, and therefore the side flap facing the closed side of the wrapped body of the content is likely to swell at the vicinity of the base end because of its nerve when the side flap is folded at the base end; particularly the looser the body is wrapped, the larger the side flap swells, with the result that the whole part of the protruding end can not be folded in along the content. Particularly when a corner part formed between the closed side of the wrapped body of the content and the open side is chamfered to an oblique or circular form, unstable side flap folding easily occurs, resulting in deteriorated appearance and lowered commodity value.

Furthermore, the side flap is folded at two places, upper and lower, by the side-folding guide; therefore, when the height of the content has been changed, it will become necessary to change the vertical size of the side-folding guide according to the change, and also to make the positional adjustment of the side-folding flap so that the side-folding guide will face the upper and lower ends of the side flap. The flap folding device, therefore, has the problem that it is not easily adjustable and usable, and furthermore becomes complicated in structure due to the adoption of the side-folding guide adjusting mechanism and large in the size of the device on the whole.

Furthermore, the upper flap and the lower flap are folded obliquely at 45 degrees at both side ends when the whole part of either of the side flaps is folded; therefore in the case of the so-called normal folding that each protruding end protrudes shorter than a half of the width of the open side of the content, the upper and lower flaps are folded separately and obliquely at 45 degrees without folding lines interfering with each other. Especially in the case of the so-called overlap folding that each protruding end protrudes longer than a half of the width of the open side of the content, the forward end of these 45-degree oblique folding lines meet within the upper and lower flaps, interfering with each other. Accordingly the forward ends of the upper and lower flaps can be folded without resistance; if, therefore, the flaps are folded forcibly, the wrapped article will have a bad outward appearance, resulting in a lowered commodity value.

Consequently, in the case of the so-called overlap folding that the length of projection of each protruding end becomes greater than a half of the width of the open side of the content from a dimensional relation between the content and the wrapping sheet, a decision will be made that flap folding is impossible, excluding the overlap folding part from the normally foldable range; then for example the size of the wrapping sheet will usually be changed to allow the so-called normal folding that the length of projection of each protruding end becomes less than a half of the width of the open side of the content. However, even this type of wrapping is impossible where very few kinds of wrapping sheets suitable for normal folding are available.

Furthermore, there is also the following problem. Each side-folding guide, after hitting against each side flap, moves horizontally along the parallel open sides of the content; therefore when the content, being light in weight, easily moves, the content is likely to move off the mounting position with a shock caused by the hitting of each side-folding guide against the side flap. And also if the content supplied has moved off the mounting position due to for example a dimensional error of the content, the mounting position of the content will further move away from a proper position because of a shock caused by the hitting of the side-folding guide against the side flap. Particularly if the hitting timing of the side-folding guide which hits against the side flap is shifted, the content easily moves off position, resulting in a defectively folded side flap.

In the prior-art wrapping machine, both the so-called fold-down wrapping for folding down the forward end of the upper flap on the outermost side along the underside of the content and the so-called fold-up wrapping for folding up the forward end of the lower flap on the outermost side along the upper side of the content are not performed by a single flap-folding device; that is, either of the fold-down wrapping and the fold-up wrapping requires an exclusive device for itself. The adoption of separate flap-folding processes for fold-down and fold-up wrapping, however, presents the problem that the device on the whole will become large in size.

SUMMARY OF THE INVENTION

The present invention has been accomplished in an attempt to solve the problems mentioned above. Accordingly, it is a first object of the present invention to fold a side flap tight without bulging at the body wrapping section near its base end; it is a second object of the present invention to fold the whole part of the side flap by folding the side flap at one upper and one lower place regardless of the height of the content; it is a third object of the present invention to fold the lower and upper flaps to a trapezoidal form without both side flaps interfering with each other even in the case of the so-called overlap folding that each protruding end protrudes longer than a half of the width of the open side of the content; it is a fourth object of the present invention to position the content properly in a mounting position; it is a fifth object of the present invention to perform normal folding and overlap folding by inputting numerical values without adjusting the side-folding guide irrespective of a change in the size of the content and the wrapping sheet; and it is a sixth object of the present invention to enable both fold-down wrapping and fold-up wrapping by a single -flap-folding process.

A technological means adopted in the present invention for the purpose of solving the above-described problems is characterized in that the side-folding guide is rotatably supported in an intermedium position in a side-flap folding direction, and the center of rotation is located close to the outside of the open side of the content, with the side flap held as-folded, so that the side-folding guide will move in contact with the open side of the content, and also in that there are formed a hitting part facing the closed side of a wrapped body of the content, off the content, on one end of the side-folding guide, and a folding part facing the side flap, off the content, on the other end of the side-folding guide.

It is preferable that the side-folding guide be located opposite to a part between the upper and lower ends of the content and a guide means be mounted which moves a part of the wrapping sheet, toward either one of the lower flap and the upper flap with the rotation of the side-folding guide in the side-flap folding direction.

Furthermore it is preferable that the guide moving means move the folding part as far as one of the upper and lower ends of the content.

It is also preferable that a transfer means be provided to laterally transfer the content with the side flaps folded, and that an oblique side is provided gently slanting toward the upper and lower center of the open side of the content as it goes toward the downstream side in the direction of transfer, against the base end of the lower flap or the upper flap which is located in the direction in which the folding part has been moved by the guide transfer means on the way of this transfer, the oblique side being located slightly protruding toward the upper and lower center of the open side of the content from the transfer surface of the content.

A pair of side-folding guides may also be arranged oppositely to the middle position between the upper and lower sides of the content, to thereby shift a contact and rotation timing with time between the side-folding guide and both side flaps at each protruding end.

Furthermore, it is preferable that four side-folding guides be mounted oppositely to the side flaps at both overhang ends which protrude from the open parallel side of the content, that these side-folding guides be arranged on two straight lines which are nearly parallel with the closed side of a wrapped body of the content with the side-folding guides off the content, and that the hitting part of the two side-folding guides mounted on each straight line and each closed side of the wrapped body of the content butt against each other at the same time.

It is also preferable to provide a reversion-holding means for forcing the hitting part to turn back in the reverse direction of side flap folding, off the content, and holding it opposite to the closed side of the wrapped body of the content, and then to operate this reversion holding means through contact and engagement according to a change in the positional relation with the side-folding guide that has been turned to the direction of folding.

The flap folding device, therefore, is characterized by the provision of an elevating means which shifts, with time, the contact rotation timing between a pair of side-folding guides and both side flaps of each overhang end, and lifts either one of the content and the side-folding guides; an input means which inputs the width of the open side of the content, the length intersecting this width at right angles, and the length of the wrapping sheet; a computing means for computing the length of projection of each overhang end of the wrapping sheet on the basis of an output of the input means; a comparison means for comparing a result of computation with a half of the width of the open side; and a control means for controlling a guide transfer means in accordance with the result of comparison made.

Furthermore, it is preferable that the elevating means be an elevator on which the content whose body part has been wrapped is mounted, control the height position of the elevator by the control means, and be so arranged that the side-folding guide may not be vertically movable for adjustment.

Furthermore it is preferable to mount the lower- or upper-flap guide for subsequently folding the side flap so that the guide can vertically reciprocate along the open side of the content, to control the level of the elevator by the control means, and at the same time to control the end-of-folding position of the guide.

The flap folding device, therefore, is also characterized by the provision of a transfer means which transfers the content whose body has been wrapped, horizontally along the upper surface of the elevator that has been lowered, next the provision of a side-folding guide which moves to hit against both side flaps at each overhang end in the course of the transfer path, thus folding inward the side flaps against the open side of the content, and an up-folding guide which comes to hit against the lower flap to fold up the lower flap along the open side, the provision of a folding guide which faces, while in contact with, the open side of the content which is brought upward by the elevator above the up-folding guide, so that the folding guide can protrude along the bottom or upper surface of the content, and the provision of a down-folding guide, between the side-folding guide and the up-folding guide, which hits against to fold the upper flap down along the open side, such that the down-folding guide can be removed out of the transfer path or can reciprocate.

According to the above-mentioned technological means of the present invention, the side-folding guide approaches the side flap until the hitting part hits against the closed side of the content whose body has been wrapped, to thereby press the wrapped body part near the base end of the side flap facing the closed side against the closed side; subsequently, the middle part of the side-folding guide makes a quarter turn while tracing a corner continued to the closed side. Thus the base end of the side flap is folded along the corner while being pulled toward its forward end, and also is pushed against the open side through the entire length from the base end to forward end of the side flap at the folding part.

As the folding part is moved in one direction toward either the lower flap or the upper flap by a guide moving means when the side-folding guide is rotated, the whole part of the side flap is pulled in the direction of elevation of the folding part, being folded particularly while the base end of the side flap located on the reverse side of the direction of elevation being pressed against the corner.

Furthermore, the folding part is moved to either one of the upper and lower ends of the content by the guide moving means at the time of rotation of the side-folding guide, thereby producing a horizontal folding line in either one of the lower flap and the upper flap arranged in the direction of this movement.

When the content is transferred laterally by the transfer means to hit the base end of the lower flap or the upper flap arranged in the direction of movement of the guide moving means against an oblique side, the lower flap or the upper flap arranged in the direction of this movement is folded only at the base end with both side flaps being pulled in the direction of movement of the guide moving means, thus partly providing a folding line between these flaps.

Next, when the contact-rotation timing of a pair of side-folding guides in relation to both side flaps of each overhang end is shifted with time, the middle part in the vertical direction of both side flaps is folded along the open side of the content, thus overlapping the forward ends of the side flaps; at the same time, the folding of both side ends of the lower and upper flaps is stopped on the way.

Furthermore, the hitting part of the two side-folding guides which are waiting on straight lines extending nearly in parallel with the closed side of the content whose body portion has been wrapped is hit against each closed side simultaneously, thereby correcting the mounting position of the content to the direction of the extension lines of the open side; thereafter, the side-folding guide makes a quarter turn while the middle part of its inner surface is tracing the corner section continued to the closed side, thus passing with its straight inner surface in contact with the parallel open side to thereby correct the mounting position of the content to the direction of the extension lines of the closed side.

Furthermore, the reversion holding means is operated into contact-engagement with the side-folding guide in the case of a change in a positional relation with the side-folding guide which has turned to the folding direction, thereby forcing the hitting part which is off the content, to turn reversely in the reverse direction of folding of the side flap.

Subsequently, the length of projection of each protruding end is computed from the inputted length of the wrapping sheet and the length of the content and a comparison is made of the result of computation with a half of the width of the open side of the content to decide either normal folding or overlap folding. The operation of the elevating means is controlled in accordance with a result of this decision, thus automatically adjusting the contact position of the side flap and the side-folding guide to the optimum normal- or overlap-folding position.

Furthermore, the side flap-to-side-folding guide contact position is automatically adjustable to the optimum normal or overlap folding position by moving by the control means the level of the elevator mounted with the content.

Furthermore, the end-of-folding position of the guide for the lower flap or upper flap to be folded subsequently to the side flap is controlled by the control means. That is, the end-of-folding position of the content can be changed according to the normal folding or the overlap folding position thus controlled.

Then, after folding of both side flaps by the side-folding guide, the content is horizontally transferred by the transfer means along the transfer path equipped with no down-folding guide, thereby folding up the lower flap by the up-folding guide. Subsequently, the content is carried upward on the elevator until the upper flap hits against the folding guide. Then the folding guide is projected along the bottom surface of the content, to thereby fold down the upper flap against the outside of the lower flap, while its forward end is folded in against the bottom surface of the content. Thereafter, the content with both side flaps folded in is horizontally transferred along the transfer path equipped with the down-folding guide, thus folding up the upper flap and then folding down the lower flap on the outside of the upper flap by the up-folding guide. And almost simultaneously, the content is brought upward on the elevator, in the course of which the folding guide is protruded along the upper surface of the content to thereby fold the forward end of the lower flap against the upper surface of the content.

The foregoing objects and other objects, as well as the actual construction and operation of the device according to the present invention, will become more apparent and understandable from the following detailed description thereof, when read in connection with the accompanying drawings.

DESCRIPTION OF THE PREFERRED EMBODIMENT

Hereinafter one embodiment of a flap folding device of a wrapping machine according to the present invention will be described with reference to the accompanying drawings.

Figure 1:
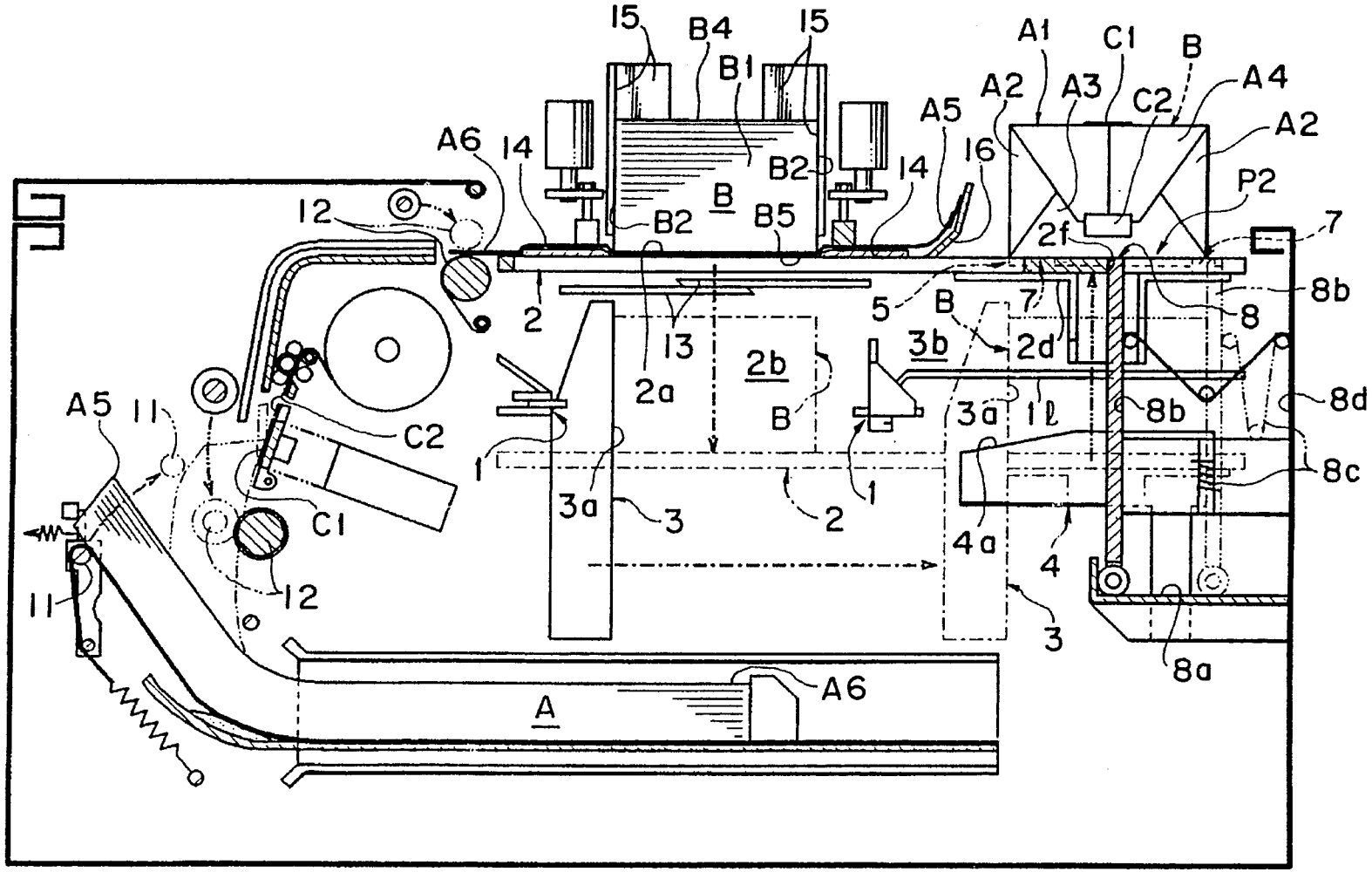
FIG. 1 is a front view in longitudinal section showing one embodiment of a flap folding device of a wrapping machine according to the present invention at both the start and end of wrapping.
Figure 2:
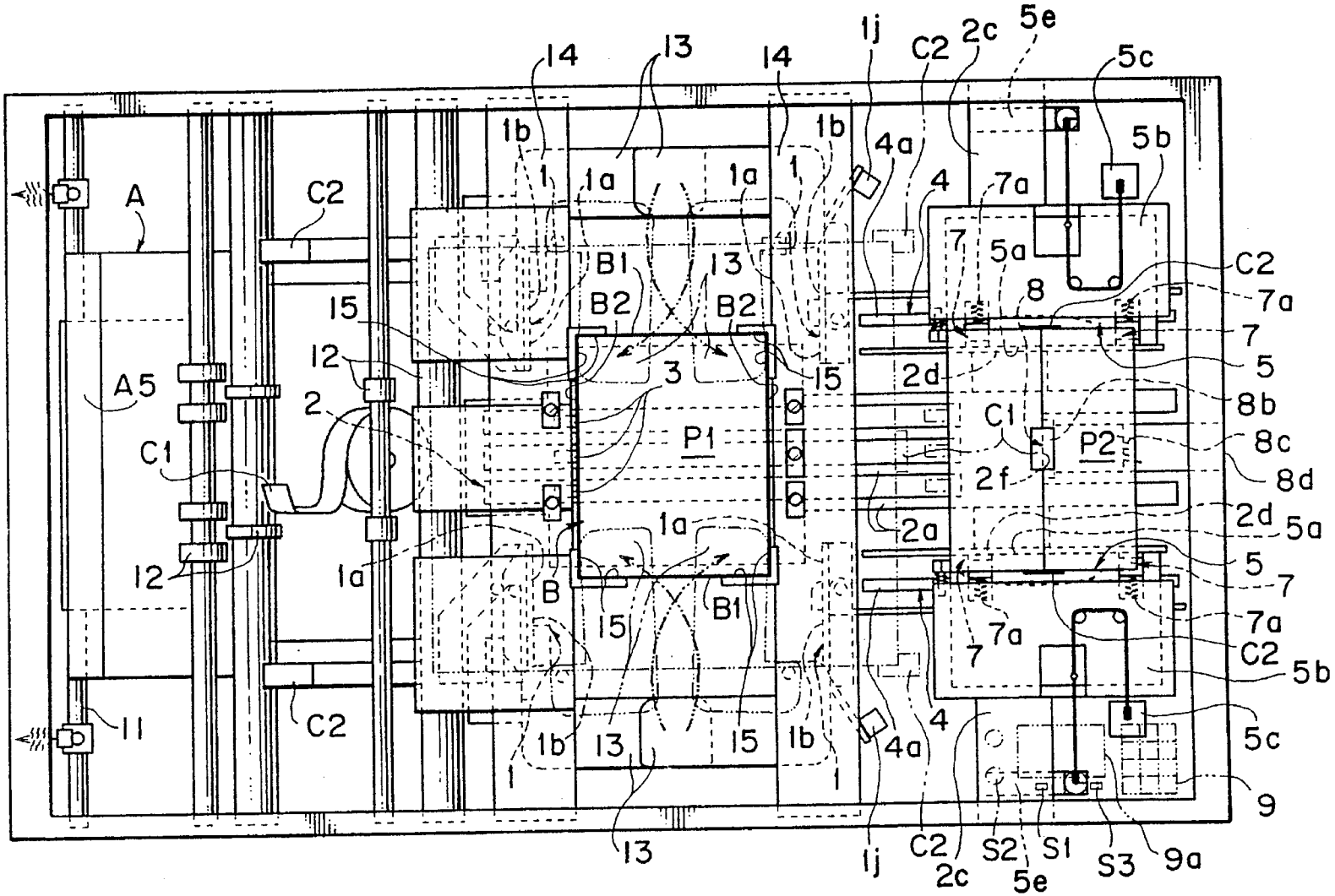
FIG. 2 is a plan view in transverse section of the same.
Figure 3A:
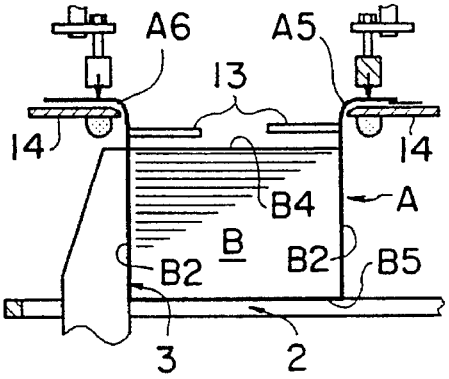
FIGS. 3(*a*)–3(*g*) are front views in partly longitudinal section showing a body wrapping process in order.
Figure 3B:
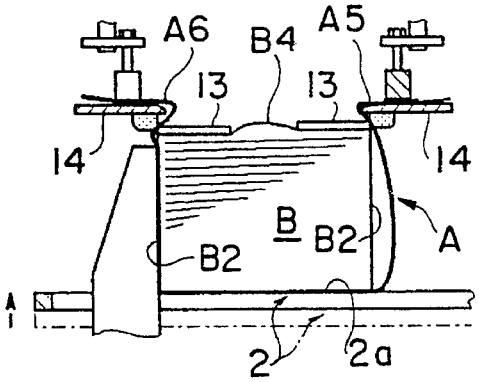
Figure 3C:
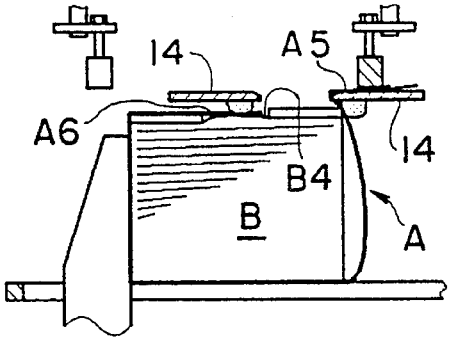
Figure 3D:
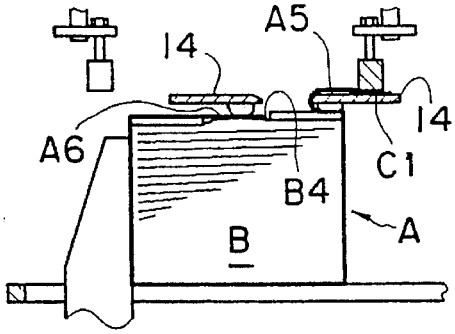
Figure 3E:
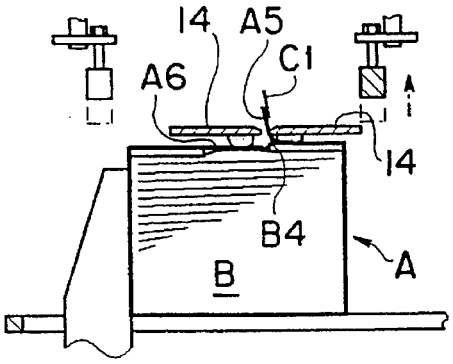
Figure 3F:
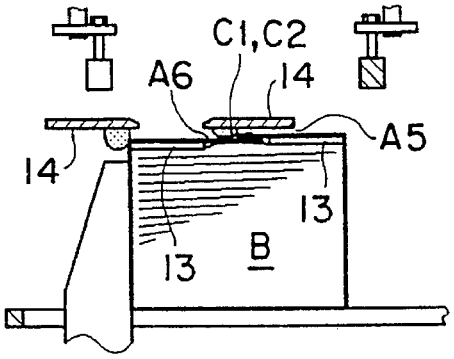
Figure 3G:
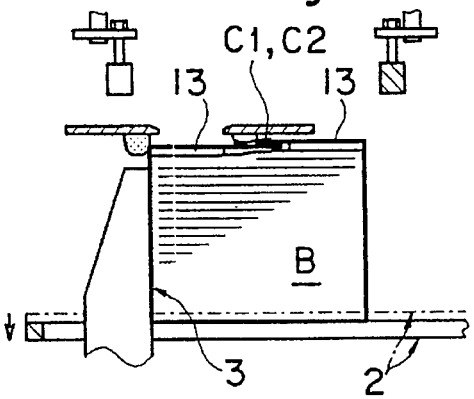

In the present embodiment, as shown in FIGS. 1 and 2, four side-folding guides 1 are provided facing side flaps A2 of both overhang ends A1, A1 protruding from parallel open sides B1, B1 of a content the body of which has been wrapped in a tubular form with a wrapping sheet A. An elevating means 2 for lifting either the content B or the side-folding guides 1 is an elevator 2. The content B after the completion of the body wrapping process is horizontally transferred by a transfer means 3 along a mounting surface 2*a* of the elevator 2 that has lowered from a wrapping start position P1. Then, after side flaps A2 of both overhang ends A1, A1 are folded inward by means of the side-folding guides 1, the lower flaps A3, A3 are folded up by the up-folding guides 4, 4. Thereafter, the elevator 2 rises to push the content B up to a wrapping end position P2, where upper flaps A4, A4 are pushed to hit against folding guides 5, 5, being folded down until they overlap the outer side of the lower flaps A3, A3, and the forward ends of the upper flaps A4, A4 are sealed with a pre-affixed adhesive tape C2, C2.

The side-folding guides 1 are made in a form of rod which is much less in height and longer in a lateral direction than the content B; of these side-folding guides 1, only two guides are located on the upstream side of the content B in such a manner that they can be reciprocated in the direction of transfer of the content B by the transfer means 3 described later, oppositely to a middle position between the upper and lower side flaps A2 on the overhang ends A1, A1 protruding in the same plane as the open sides B1, B1 of the content B the body of which has been wrapped. And the other two side-folding guides 1 located on the downstream side of the content B are installed unmovable in the direction of transfer of the content B. Then, with the lateral middle position of the guides 1 rotatably supported in the direction of folding of the side flaps A2, hitting parts 1*a* are formed oppositely nearly in parallel with the closed sides B2, B2, in the initial state that the guides are off the content B, at one end of a straight inner surface facing the content B, and that folding parts 1*b* are formed, on the other end of the inner surface, oppositely nearly in parallel with the side flaps A2, in the initial state that the guides are off the content B.

Figure 10:
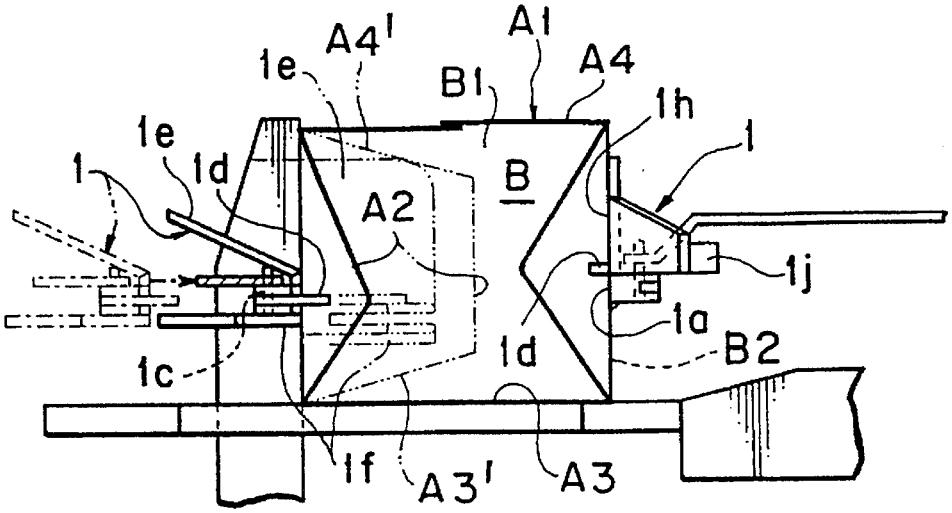
FIG. 10 is a partly cutaway front view of the same state.
Figure 11:
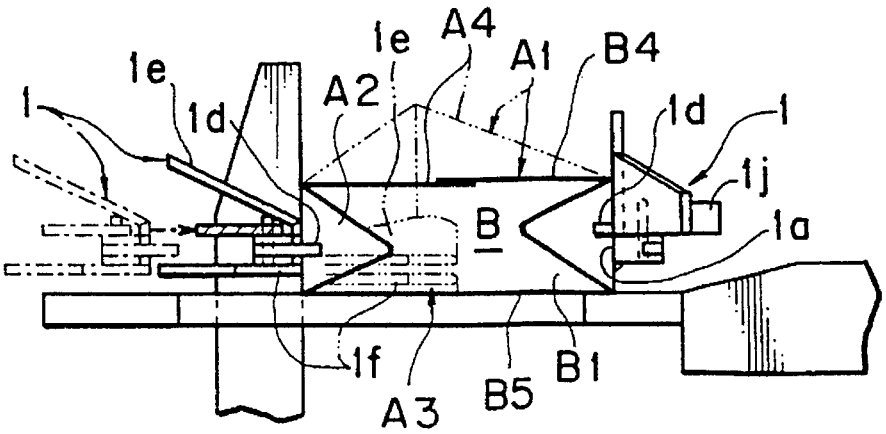
FIG. 11 is a partly cutaway front view of the overhang end in the case of short overhang.

Furthermore, these side-folding guides 1 are rotatably supported each on a support shaft 1*c* which forms a spiral guide path as a guide moving means. As shown in FIGS. 10 and 11, when the hitting part la comes into contact with the side flaps A2, the middle part of its inner surface makes a quarter turn in the direction of folding of the side flaps A2 while tracing the corners B3 which are equivalent to the four corners of the sides B1, B1, B2, B2 of the content B. With this quarter turn, the folding part 1*b* is lowered to a specific level toward the lower flaps A3, A3 until it faces the forward end of the side flaps A2 of the folding part 3*b*, where a sheet-like directing plate is protrusively installed, horizontally protruding toward the middle part in a vertical direction of the side flaps A2.

Figure 9:
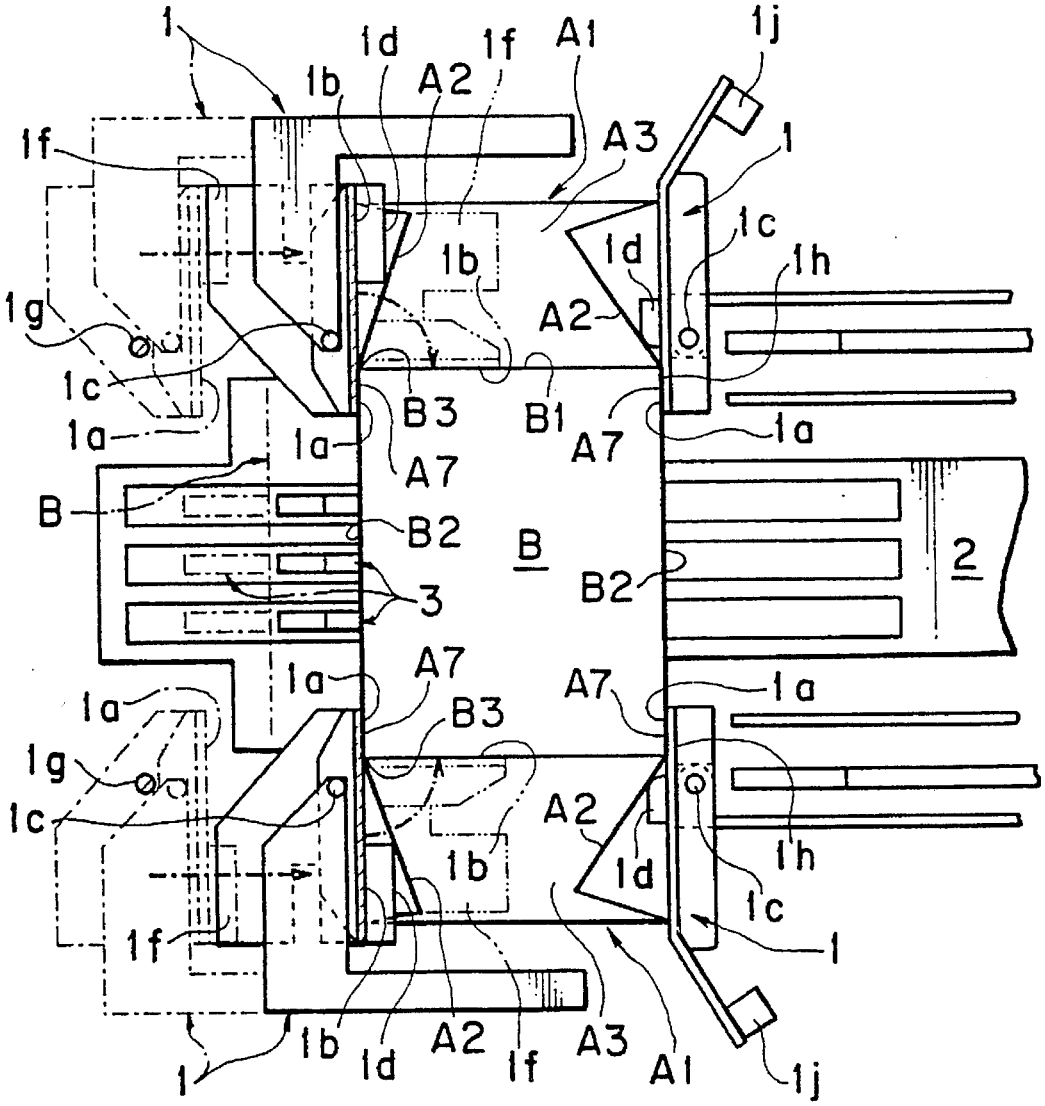
FIG. 9 is a partly enlarged plan view in transverse section showing the side flap in the course of folding.

The side-folding guides 1, 1 located upstream are rotatably mounted as up-folding means along the upper end of the inner surface thereof, moving the movable upright surfaces 1*e*, 1*e* into contact with, and away from, the open sides B1, B1 of the content B. The movable upright surfaces 1*e*, 1*e*, in the initial state when they are off the content B, are inclined in a direction in which the upright surfaces 1*e*, 1*e* move away from the open sides B1, B1; and, contacting the side flaps A2, A2, the side-folding guide makes a quarter turn while tracing the corners B3, B3. The movable upright surfaces 1*e*, 1*e* are then gradually moved upright by a cam or the like, moving pressing surfaces 1*f*, if horizontally outward from the bottom end of the folding parts 1*b*, 1*b* as shown in FIG. 9.

Figure 15:
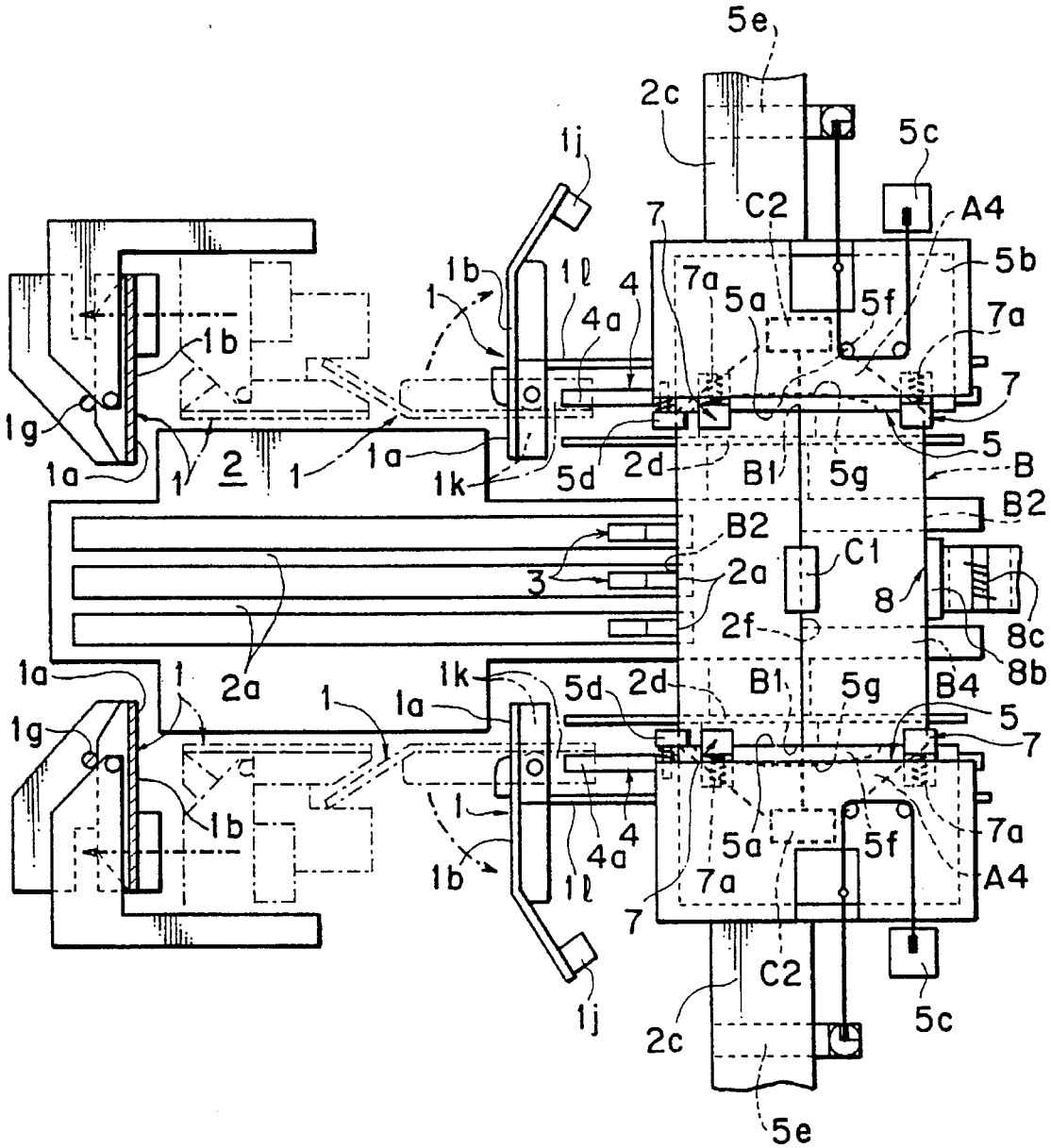
FIG. 15 is a partly enlarged plan view in transverse section showing the upper flap at the start of down folding.

Furthermore, the support shafts 1*c*, 1*c* of these upstream side-folding guides 1, 1 are elastically supported, when required, toward the center of a crosswise direction which is the direction of the extension lines of the closed sides B2, B2 of the content. And then the support shafts 1*c*, 1*c* are connected with a driving unit such as a stepping motor, and moved forwardly and backwardly by this driving unit. On the way of the backward path, return projections 1*g*, 1*g* are fixedly installed as the reversion holding means as shown in FIG. 15.

The driving unit of the upstream side-folding guides 1, 1 is connected with a control circuit 10 described later, which controls the operation of the driving unit. In the initial state immediately after the completion of the body wrapping process, the hitting parts 1*a*, 1*a* and the folding parts 1*b*, 1*b* are held on standby in a position where the wrapping sheet A and the content B being carried downward on the elevator 2 described later are not interfered with. Nearly simultaneously with the forward movement of the transfer means 3 described later, the hitting parts 1*a*, 1*a* are moved in the same direction. When an overlap-folding signal has been inputted from the control circuit 10, the folding parts 1*b*, 1*b* stop nearly in the medium position of the open sides B1, B1 of the content B after the completion of the first transfer of the content B by the transfer means 3, then approaching the folding parts 1*b*, 1*b* of the downstream side-folding guides 1, 1 which rotate at the second transfer of the following content B to thereby delivering the content to the downstream side-folding guides 1, 1 while holding the upstream side flaps A2, A2 that have been folded.

When a normal-folding signal has entered from the control circuit 10, after the completion of the first transfer of the content B by the transfer means 3 described later, the folding parts 1*b*, 1*b* are moved forward as far as the position where the upstream side flaps A2, A2 are folded. Subsequently, the folding parts 1*b*, 1*b* are moved further forward at the same speed simultaneously as the transfer speed of the content B, approaching the folding parts 1*b*, 1*b* of the downstream side-folding guides 1, 1 that have rotated. In this position, the folding parts 1*b*, 1*b* stop forward movement. Thus the content B is delivered to the downstream side-folding guides 1, 1 while holding the upstream side flaps A2, A2 folded, and then the upstream side-folding guides 1, 1 are moved backward to the upstream side. Thereafter, the upstream side-folding guides 1, 1 are moved backward to the upstream side, into engagement with the return projections 1*g*, 1*g* on the way of backward movement, thereby forcing the side-folding guides 1, 1 to turn in the reverse direction of folding to reset to the initial state.

Figure 13:
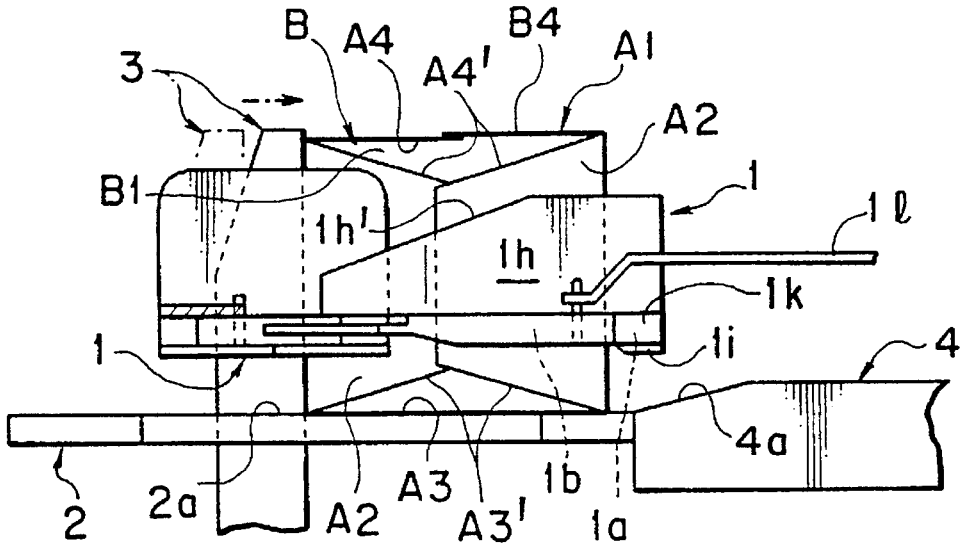
FIG. 13 is a partly cutaway front view of the same state.
Figure 14:
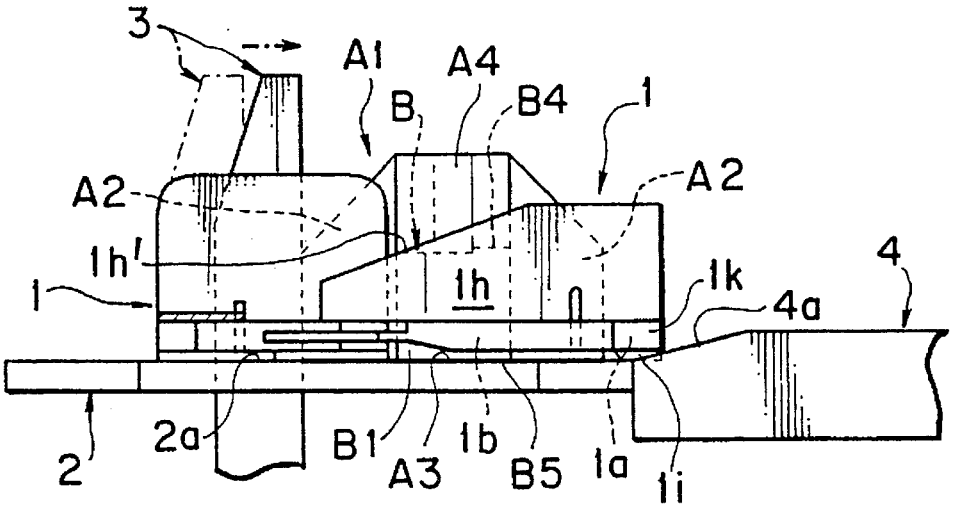
FIG. 14 is a partly cutaway front view of the overhang part in the case of short overhang.

The side-folding guides 1, 1 located on the downstream side have fixed upright surfaces 1*h*, 1*h* along the upper edge of the inner surface, protruding oppositely to the open sides B1, B1 of the content B. The fixed upright surfaces 1*h*, 1*h* are provided, as an up-folding means, at the upper edge continued with upward inclined sides 1*h*', 1*h*' inclined upward as they go from the folding part 1*b*, 1*b* side toward the hitting part 1*a*, 1*a* side as shown in FIGS. 13 and 14. And also projections 1*i*, 1*i* having an acute-angle section are provided on the lower end of the hitting parts 1*a*, 1*a* inclined in a direction in which they go away from the open sides B1, B1 of the content B, as they move toward the forward end of the folding parts 1*b*, 1*b* of the fixed upright surfaces 1*h*, 1*h*.

Furthermore, temporarily holding parts 1*j*, 1*j* using for example permanent magnets or electromagnets are fixedly mounted as a reversion holding means in the vicinity of the holding parts 1*b*, 1*b* of the downstream side-folding guides 1, 1; the hitting parts 1*a*, 1*a* are held on standby nearly in parallel with the downstream closed side B2 of the content B that has been transferred by the transfer means 3 described later, and at the same time, inclined cam faces 1*k*, 1*k* on the underside of these hitting parts 1*a*, 1*a*. Then, the inclined cam faces 1*k*, 1*k* that have rotated in the direction of folding when contacting the side flaps A2, A2, are engaged with the inclined sides 4*a*, 4*a* of the up-folding guides 4, 4 described below. These downstream side-folding guides 1, 1 are forced to turn in the reverse direction of folding, to reset to the initial state, to thereby facilitate the rotation of the hitting parts 1*a*, 1*a* not illustrated in the reverse direction of folding when needed.

Figure 16:
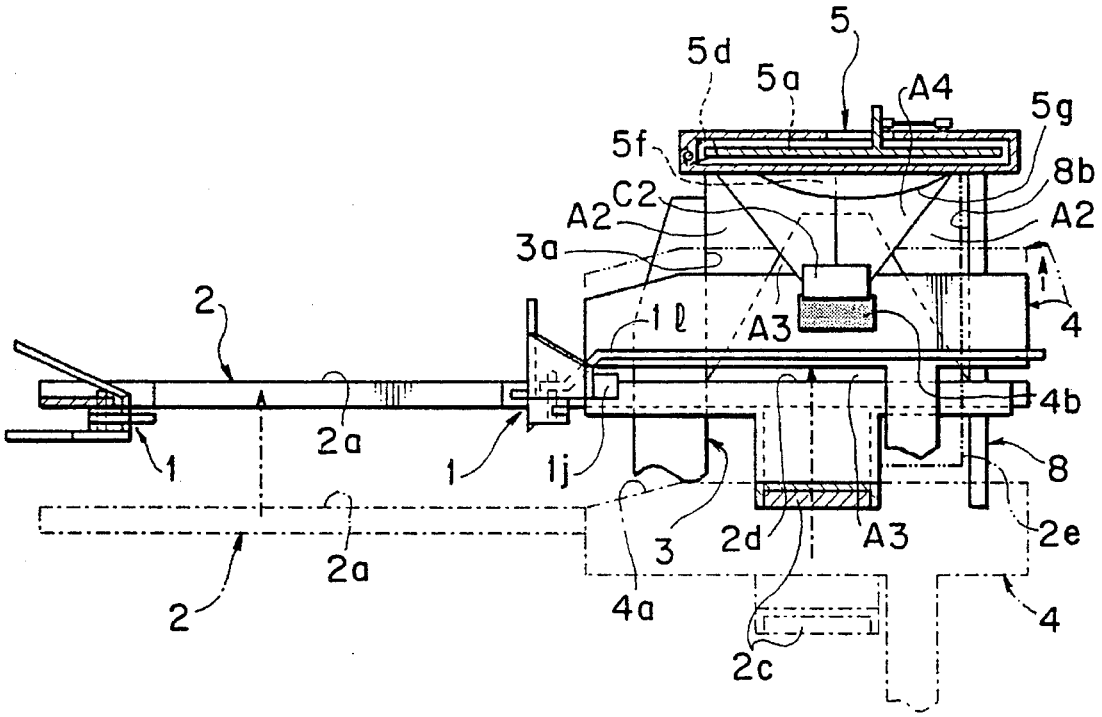
FIG. 16 is a partly cutaway front view of the same state.

Also, when the content B is high, pressing rods 11, 11 are installed, as occasion requires, nearly horizontally through from the support shafts 1*c*, 1*c* of the downstream side-folding guides 1, 1 to the up-folding guides 4, 4 described below as shown in FIG. 16; and there is provided a clearance between the pressing rods 11, 11 and the open sides B1, B1 of the content B through which the up-folding guides 4, 4 can pass. Then the pressing rods 11, 11 are brought into contact with the side flaps A2 that have been folded, thereby holding the folded state of the side flaps A2 until the completion of up-folding of the lower flaps A3, A3 by the up-folding guides 4, 4.

Figure 4:
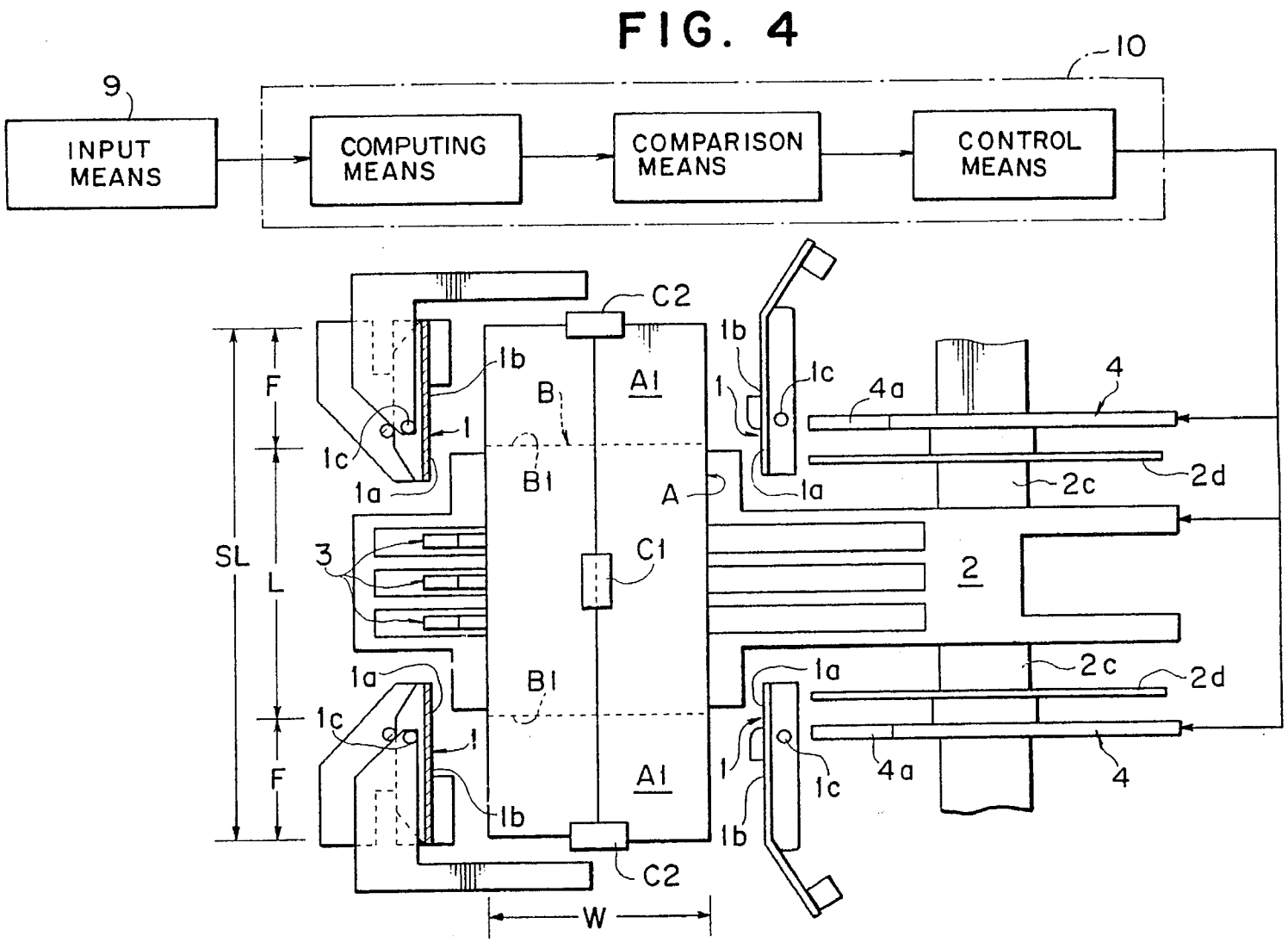
FIG. 4 is a plan view in transverse section and a block diagram showing the end of the body wrapping process.
Figure 5:
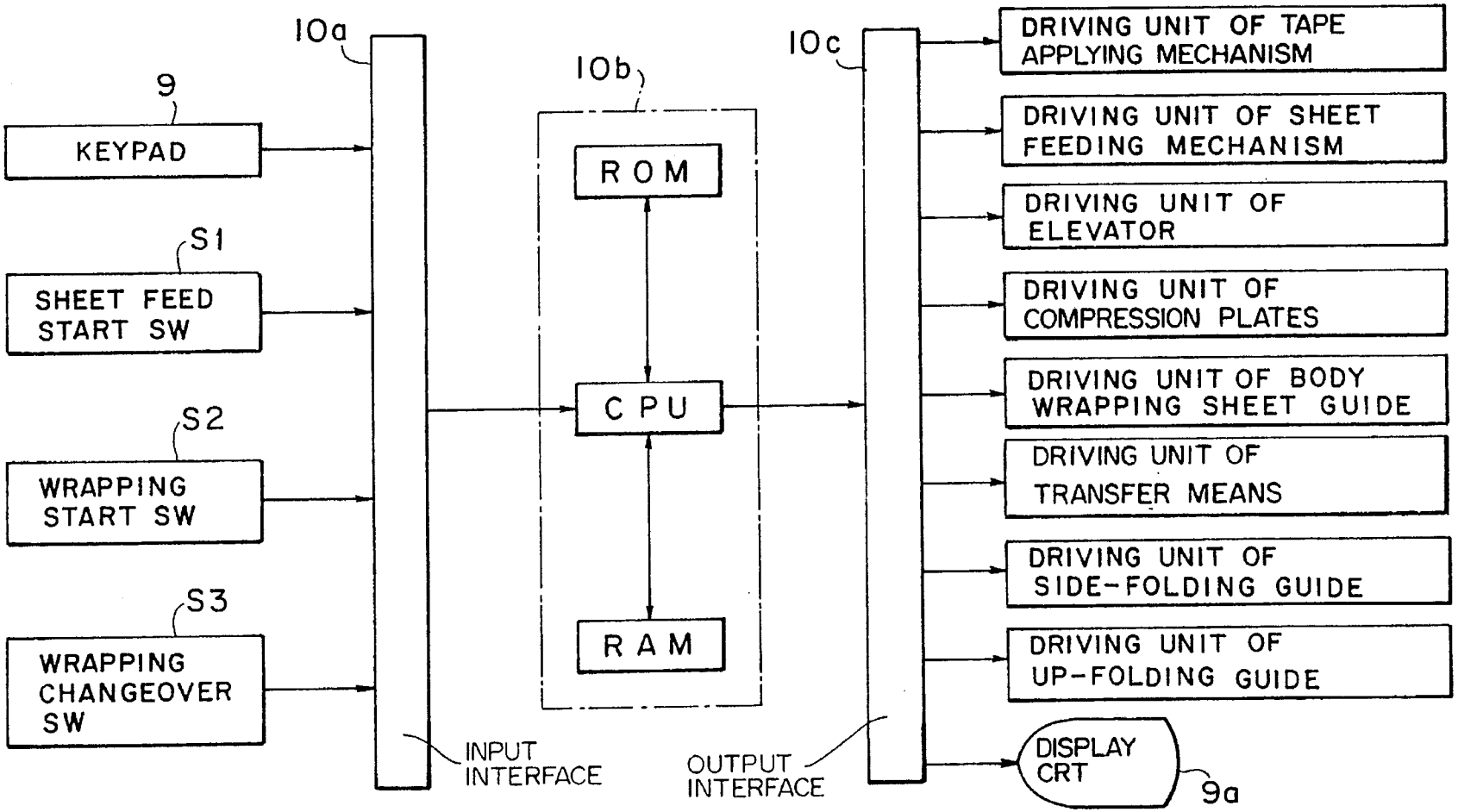
FIG. 5 is a circuit diagram of a control circuit.

The elevator 2 has a mounting surface 2*a* which the bottom surface B5 of the content B contacts; the mounting surface 2*a* is arranged so that it can reciprocate vertically along an elevating path 2*b*. This mounting surface 2*a* in the direction that the content B is horizontally carried by a transfer means 3 described later is formed wide enough, as shown in FIG. 4, to mount two contents B in parallel in the direction of transfer, and also is formed short in the lateral direction which meets the direction of transfer at right angles, that is, short in the lateral direction at the downstream side than at the upstream side in the direction of transfer, and nearly the same as, or shorter than, the length in the lateral direction of the smallest content B. Under the elevator 2 on the downstream side are connected arms 2*c*, 2*c* which protrude outside in the lateral direction.

On these arms 2*c*, 2*c* are vertically mounted hanging-flap receiving bases 2*d*, 2*d*, which can reciprocate in the lateral direction. These hanging-flap receiving bases 2*d* 2*d* are so arranged that their upper surface is at the same level as the mounting surface 2*a*, and at the same time, are connected, as shown in FIG. 16, by connecting pieces 2*e*, 2*e* to support frames 5*b*, 5*b* of the folding guides 5, 5 described later, to thereby support the upper surface of the hanging-flap receiving bases 2*d*, 2*d* contiguously to the vicinity of the right and left ends of the bottom surface B5 of the content B, correspondingly to a change in the length of the content B. To the arms 2*c*, 2*c* and the mounting surface 2*a* is connected the driving unit of for example the stepping motor, to move the driving unit upward and downward.

The driving unit of the elevator 2 is connected to, and controlled by, the control circuit 10 described later, like the driving unit of the above-described upstream side-folding guides 1, 1. When an overlap-folding signal has been inputted from the control circuit 10 in the initial state immediately after the completion of the body wrapping process, the mounting surface 2*a* and the hanging-flap receiving bases 2*d*, 2*d* are elevated so that a vertically nearly middle position will face the hitting parts 1*a* of the side-folding guides 1 stated above, regardless of the height of the content B.

When a normal-folding signal has been entered from the control circuit 10, the mounting surface 2*a* and the hanging-flap receiving bases 2*d*, 2*d* are moved upward or downward until the bottom surface B5 of the content B is at nearly the same level as the bottom end of the folding part 1*b* of the side-folding guides 1 that has moved downward, regardless of the height of the content B; then after the completion of forward movement of the transfer means 3 described later and the first upward movement of the up-folding guides 4, 4, the mounting surface 2*a* and the hanging-flap receiving bases 2*d*, 2*d* are moved upward to the same upper-limit position as the upper surface of the folding guides 5, 5 described later. Then, with the start of the subsequent body wrapping process, the mounting surface 2*a* and the hanging-flap receiving bases 2*d*, 2*d* are lowered to reset to the initial state.

The transfer means 3 is so mounted vertically through the mounting surface 2*a* of the elevator 2 as to reciprocate in the direction of the extension lines of the open sides B1, B1 facing the upstream closed side B2 of the content B, with the upper end of a vertical pushing surface 3*a* arranged below the folding guide 5, 5 described later. The transfer means 3 is connected with a driving unit such as the stepping motor, by which the pushing surface 3*a* is reciprocated.

The driving unit of the transfer means 3 is connected to the control circuit 10 described later, by which the operation of the driving unit is controlled. In the initial state immediately after the completion of the body wrapping process, the pushing surface 3*a* is held on standby on the same vertical surface as the upstream closed side B2 of the content B. The forward movement of the pushing surface 3*a* is started nearly simultaneously with the forward movement of the upstream side-folding guides 1, 1 until the downstream closed side B2 of the content B comes to a stop in a position, hitting against the hitting parts 1*a*, 1*a* of the downstream side-folding guides 1, 1. Subsequently, the upstream side-folding guides 1, 1 move forwardly as far as a specific position of the open sides B1, B1, and the pushing surface 3*a* moves again further forwardly at the same speed, stopping in a position located further downstream of the downstream side-folding guides 1, 1, then moving backward to the upstream side on the way of, or after the end of, upward movement of the elevator 21, to return to the initial state.

The up-folding guides 4, 4 are vertically installed on nearly the same plane as the parallel open sides B1, B1 of the content, and close to the downstream side of the standby position of the downstream side-folding guides 1, 1. At the upper end of the up-folding guides 4, 4 on the lateral guides 1, 1 side are formed the inclined sides 4*a*, 4*a* which are gently inclined upward, facing the lower flaps A3, A3 as shown in FIG. 16, so that the up-folding guides 4, 4 are vertically movably supported, to thereby protrude such engaging parts 4*b*, 4*b* as a sponge, which contact the adhesive surface of the adhesive tapes C2, C2 affixed on the forward end of the upper flaps A4, A4. Also, the up-folding guides 4, 4 are connected to the driving unit such as the stepping motor, by which their vertical movement is effected.

The driving unit of the up-folding guides 4, 4 is connected with the control circuit 10 described later, by which the operation of the up-folding guides 4, 4 will be controlled. In the initial state immediately after the completion of the body wrapping process, the inclined side 4*a*, 4*a* are moved to adjust their level slightly higher than the mounting surface 2*a* irrespective of the downward stroke of the mounting surface 2*a* of the elevator, on the basis of an overlap- or normal-folding signal entered from the control circuit 10. When the overlap-folding signal is received from the control circuit 10 after the end of the forward movement of the transfer means 3, the content B is moved upward along the open sides B1, B1 as far as the position which is lower by a specific length than the vicinity of the upper surface B4 of the content B and will not contact the oblique folding line A4' of the upper flaps A4, A4. Thereafter, the up-folding guides 4, 4 are further raised to the vicinity of the lower end of the folding guides 5, 5 at the same rate as the speed of the mounting surface 2*a* at the time of upward movement of the mounting surface 2*a*.

Figure 17:
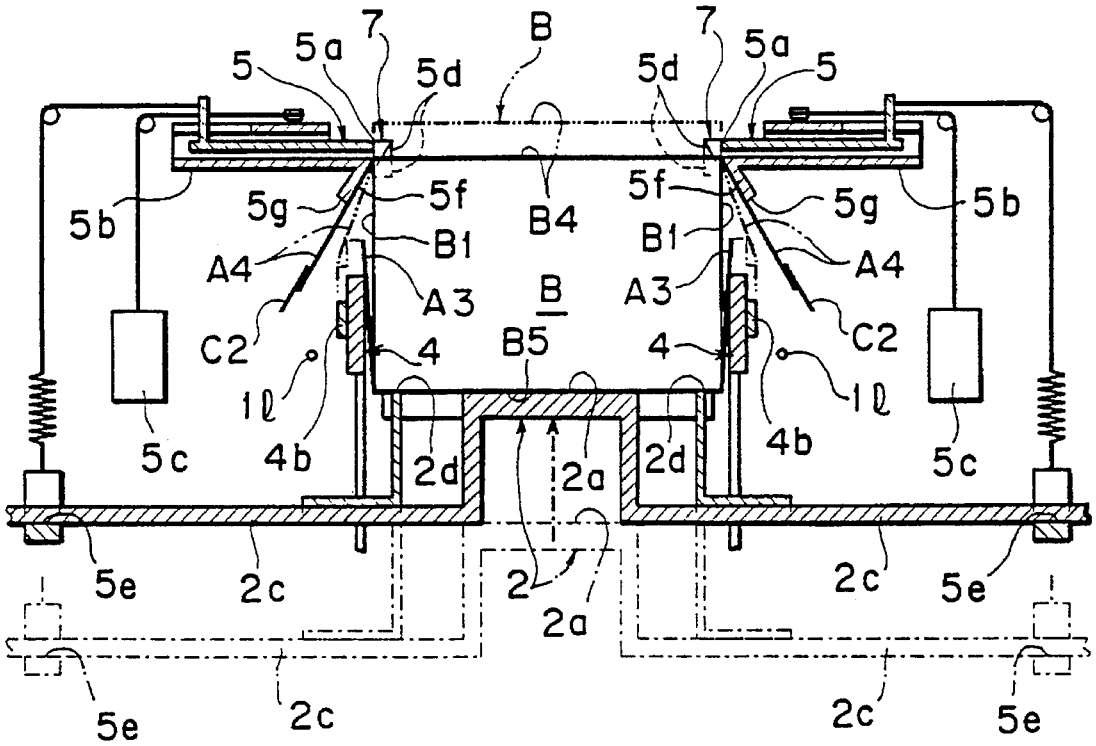
FIG. 17 is a longitudinal sectional side view of the same state.

The folding guides 5, 5 are supported above the up-folding guides 4, 4 and connected to a driving unit so that their inner ends 5*a*, 5*a* can move in the lateral direction toward, or away from, each other, or that the support frames 5*b* 5*b* are laterally adjustably mounted above the up-folding guides 4, 4 correspondingly to a change in the length of the content B as shown in FIG. 17. The inner ends 5*a*, 5*a* of the folding guides 5, 5 are laterally movably supported on the support frames 5*b*, 5*b*. The folding guides 5, 5 are also connected to weights 5*c*, 5*c* which give a specific pressure in a direction in which the inner ends 5*a*, 5*a* approach each other, to stoppers 5*d*, 5*d* which stop the projection of the inner ends 5*a*, 5*a* and also release to allow the projection of the inner ends 5*a*, 5*a* by contacting the upper surface B4 of the content B when the elevator 2 has ascended, and to reset means 5*e*, 5*e* which engage the stoppers 5*d*, 5*d* when the projected inner ends 5*a*, 5*a* have been moved in the reverse direction of projection.

When the inner ends 5*a*, 5*a* of the folding guides 5, 5 are reciprocated by the driving unit, this driving unit continues to, and is controlled by, the control circuit 10 described later. In the initial state, the inner ends 5*a*, 5*a* are kept on standby on the same plane as the open sides B1, B1 of the content B which is moved upward by the elevator 2, and are moved out along the upper surface B4 of the content B immediately before the ascending content B passes between the inner ends 5*a*, 5*a*, and thereafter are pressed with a specific amount of pressure against the open sides B1, B1 of the ascending content B. Then, immediately after the content B that has ascended passes through between the inner ends 5*a*, 5*a*, the inner ends 5*a*, 5*a* protrude out along the bottom surface B5 of the content B. After the end of this projection, the inner ends 5*a*, 5*a* are moved in the reverse direction of projection simultaneously with the descent of the elevator, then returning to the initial state.

When the inner ends 5*a*, 5*a* of the folding guides 5, 5 are to be moved by the weights 5*c*, 5*c* in a direction in which they approach each other, the weights 5*c*, 5*c* are connected to the inner ends 5*a*, 5*a* by a wire member such as a wire, which are suspended by a rotatable roller installed on the support frames 5*b*, 5*b*, to thereby constantly press the inner ends 5*a*, 5*a* by the weight toward each other.

The stoppers 5*d*, 5*d* are vertically movably mounted on the support frames 5*b*, 5*b*, moving vertically into contact with, and away from, the inner ends 5*a*, 5*a* on the way of descent of the content B on the elevator 2. The stoppers 5*d*, 5*d* are constantly pressed by an elastic member such as a spring in a direction in which they will contact the inner ends 5*a*, 5*a*, and also are moved away from the inner ends 5*a*, 5*a* by the hitting of the right and left ends of the upper surface B4 of the ascending content B.

The reset means 5*e*, 5*e* provide a power for descending for example the elevator 2 or moving back the transfer means 3 when starting operation after the completion of protrusion of the inner ends 5*a*, 5*a* by the weights 5*c*, 5*c*; in the present embodiment, the inner ends 5*a*, 5*a* are connected by an elastic member such as a spring or a wire member such as a wire to the arms 2*c*, 2*c* protruding in the lateral direction from the underside of the elevator 2. After the descent of the elevator 2 from the upper-limit position to a specific level position, the inner ends 5*a*, 5*a* are moved away from each other, thus returning to the initial state.

Furthermore, below the inner ends 5*a*, 5*a* of the folding guides 5, inclined surfaces 5*f*, 5*f* are formed continued to the support frames 5*b*, 5*b*, inclining downward in a direction in which they move away from the open sides B1, B1 of the content B as it goes downward, or formed integral with the inner ends 5*a*, 5*a*. And there are formed angle sections 5*g*, 5*g* projecting downward, that is, toward most folding down the upper flaps A4, A4, at the central part facing the center of the widthwise direction of the upper flaps A4, A4 before folding down the lower end of these inclined surfaces 5*f*, 5*f*.

Figure 19:
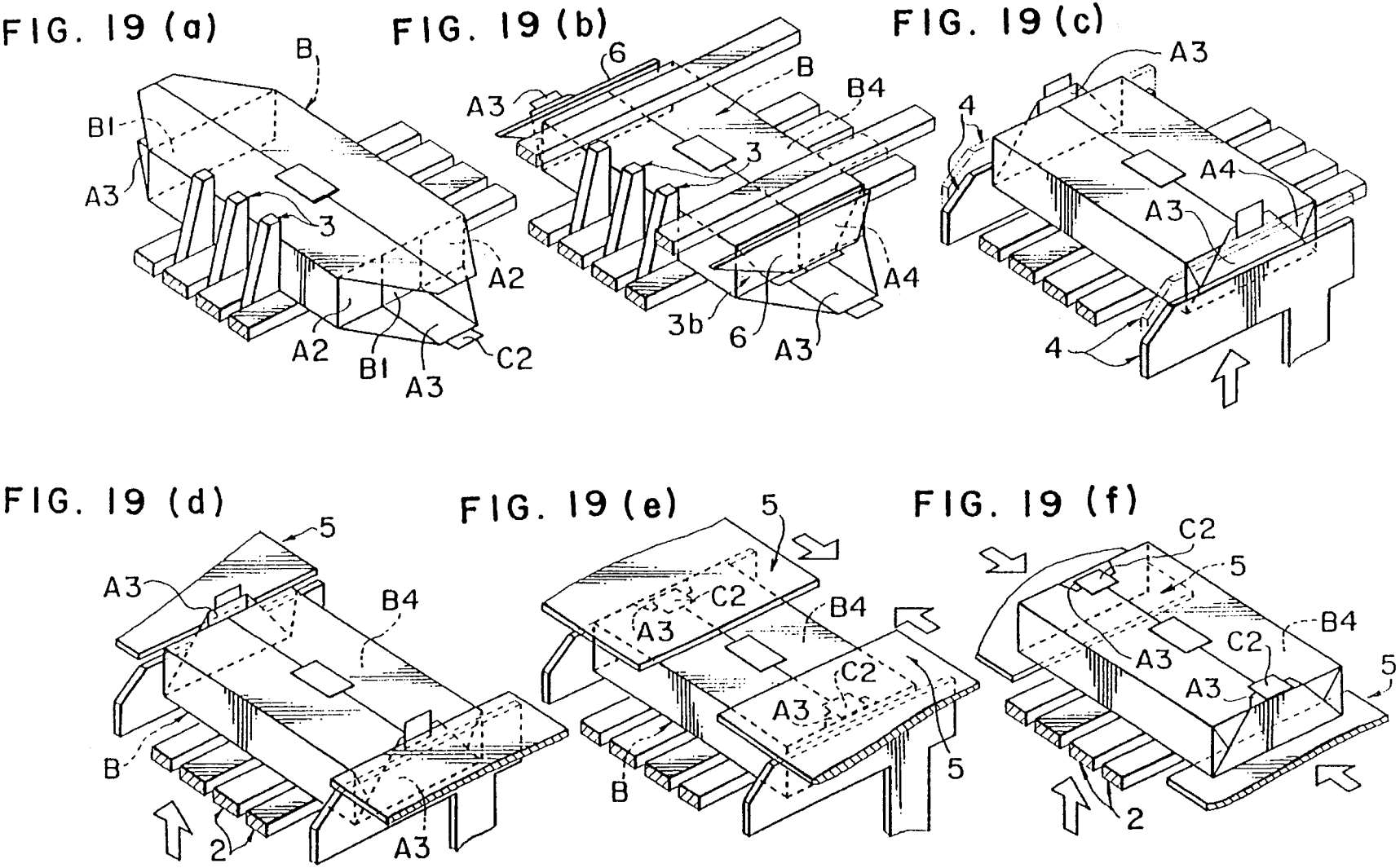
FIGS. 19(*a*)–19(*p*) are perspective views showing the flap folding processes of the up-folding wrapping in order.

Furthermore, between the side-folding guides 1 and the up-folding guides 4, 4 are arranged down-folding guides 6, 6 as shown in FIG. 19 in the transfer path 3*b* on which the content B is horizontally carried by the transfer means 3; the down-folding guides 6, 6 incline downward as for example the content B goes toward the downstream side in the direction of transfer, hitting to fold down the upper flaps A4, A4 along the open sides B1, B1, and, at the same time, being supported removable out of the transfer path 3*b* or movable backward and forward.

Figure 12:
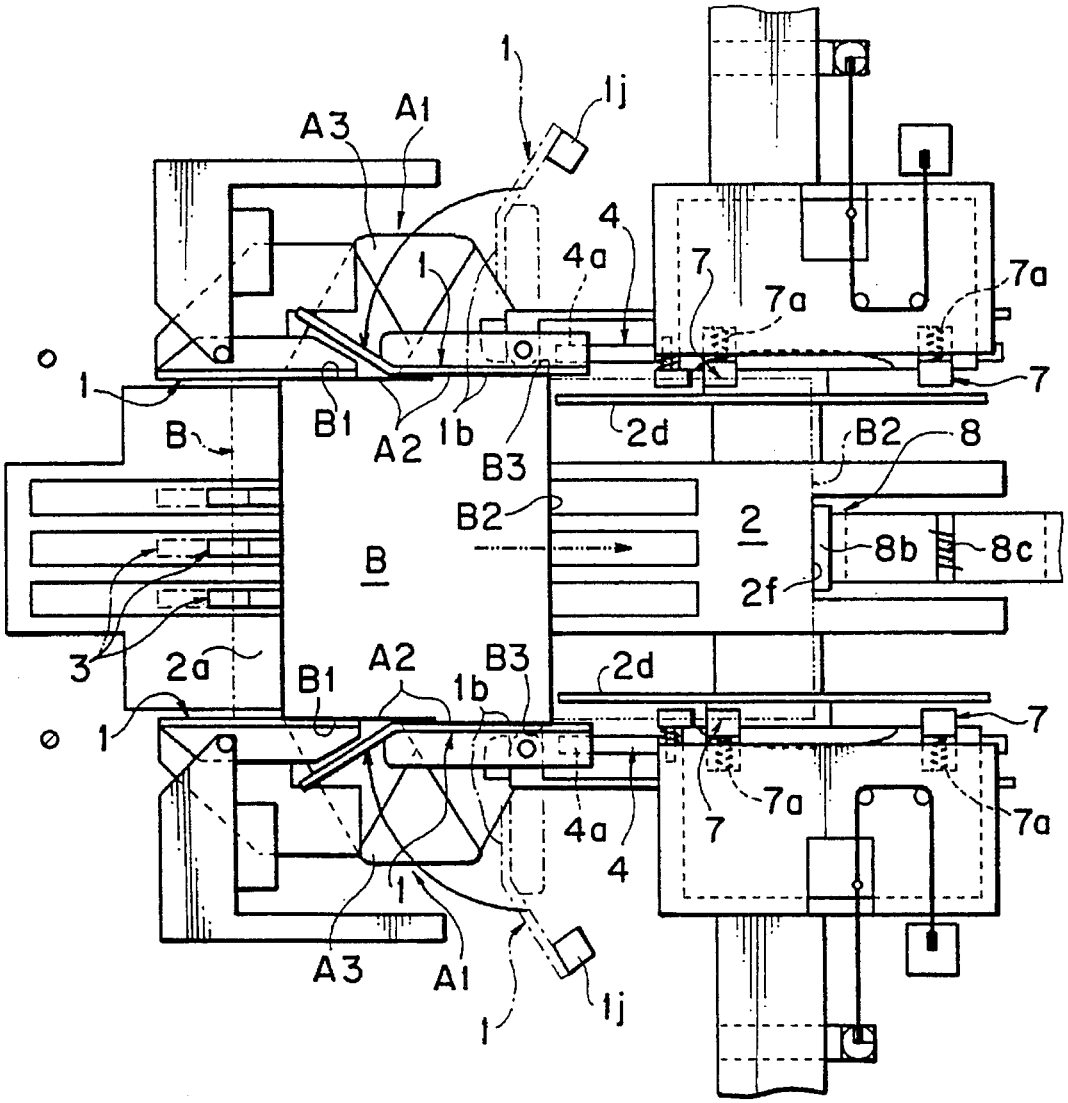
FIG. 12 is a partly enlarged plan view in transverse section showing the side flap immediately before the end of folding.

Furthermore, near the folding guides 5, 5 is installed a support means which elastically protrudes along the bottom surface B5 of the content B that has been carried upward on the elevator 2. This support means, as shown in FIG. 12, comprises a latch 7 of a little projection which projects from the support frames 5*b*, 5*b* of the folding guides 5, 5 toward the right and left ends of the bottom surface B5 through an elastic member 7*a* such as a spring, and a latch of large projection which projects toward nearly the center of the bottom surface B5, moving into, and out of, a recess 2*f* formed by cutting in the downstream end of the mounting surface 2*a* of the elevator 2. The upper end surfaces of these latches 7 and 8 are arranged at much the same level as the upper surfaces of the folding guides 5, 5 and support the bottom surface B5 of the content B in its projected state.

The latch 8 which projects largely has an upright piece 8*b* on the base 8*a* arranged at a lower level than the lower limit position of the mounting surface 2*a* as shown in FIG. 1; the upright piece 8*b* is movable backward and forward in the direction of transfer of the content B which is carried by the transfer means 3. Between this upright piece 8*b* and the frame 8*d* is interposed an elastic member 7*c* such as a spring for pressing the upright piece 8*b* constantly toward the upstream side.

Furthermore, in the case of the present embodiment, the wrapping sheet A wrapped on the body of the content B is heaped with the forward ends A5 bent obliquely upward as shown in FIG. 1. The forward ends A5 thus bent are further repeatedly bent and bent back by the use of a tape attaching mechanism 11, thus attaching the adhesive tapes C1, C2, C2, partly projected, on the forward end A5 of the wrapping sheet A located at the downstream end in the direction of heaping, and then feeding out one by one by a sheet feeding mechanism 12 toward a wrapping start position P1, on a specific position on the elevator 2.

With the content B placed on the wrapping sheet A thus fed, the wrapping sheet A and the content B are lowered by the elevator 2 as shown in FIG. 3(*a*), the wrapping sheet A being folded up nearly in a form of U letter along the sides B2, B2 and the bottom surface B5 of the content B. Thereafter, the elevator 2 is slightly moved upward as shown in FIG. 3(*b*), thereby holding the content B between the compression plates 13, 13, by which the content B is compressed from both above and below. Then, the body wrapping guides 14, 14 are moved in a direction in which they approach each other along the upper surface B4 of the content B as shown in FIGS. 3(*c*) to (*f*), thus folding to overlap the forward end A5 and last end A6 of the wrapping sheet A along the upper surface B4 of the content B. At the same time, the adhesive tapes C1, C2, C2 are attached across the forward end A5 and the last end A6 to seal the content B. Thereafter the elevator 2 moves slightly downward as shown in FIG. 3(*g*), releasing the compression from the content B. Finally the compression plates 13, 13 are pulled out, thus finishing the body wrapping process.

In the meantime, mounted on the wrapping start position P1 are reference guides 15 above the elevator 2, facing either one of both sides B2, B2 facing the content B and at least remaining sides B1, B1 as shown in FIGS. 1 and 2. The content B is properly positioned by hitting its sides B1, B1, B2, B2 against the reference guides 15 when placed in the wrapping start position P1 thus surrounded. Between the wrapping start position P1 and the wrapping end position P2 is installed a guide path 16 for holding the upward bent forward end A5 of the wrapping sheet A affixed with the adhesive tapes C1, C2, C2.

Furthermore, on the upper surface of the device having the wrapping start position P1 and the wrapping end position P2 are installed, as shown in FIG. 2, a sheet feed start switch S1, a wrapping start switch S2, a wrapping changeover switch S3, and an input means 9, for example a keypad. The input means 9, as shown in FIG. 4, is connected with the control circuit 10, to variably enter the width W of each open side B1, length L intersecting this width W, and height of the content B before starting wrapping every time these sizes are changed, and also to variably enter the length SL and width of the wrapping sheet A before wrapping is started, and then displays these values entered on a display 9*a* such as a CRT.

The control circuit 10 comprises a computing means, a comparison means, and a control means, and has an input interface 10*a*, a microcomputer 10*b* comprising ROM, RAM and CPU, and an output interface 10*c*.

The input interface 10*a* functions to select either the output to the CPU an input value from the input means 9 or the output to the CPU an output signal from the sheet feed start switch S1, the wrapping start switch S2 and the wrapping changeover switch S3.

The ROM of the microcomputer 10*b* stores a program for controlling the CPU. The CPU takes in a necessary outside data from the input interface 10*a* in accordance with the program, performs arithmetic processing while receiving data from, and outputting data to, the RAM, and outputs a processed data to the output interface 10*c* when required.

The output interface 10*c*, receiving an output signal from the CPU, operates the driving unit of the tape applying mechanism 11 and the driving unit of the sheet feed mechanism 12 in order by manually operating the sheet feed start switch S1, operates the driving unit of the elevator 2, the driving unit of the compression plates 13, 13, the driving unit of the body wrapping guides 14, 14, the driving unit of the transfer means 3, the driving unit of the upstream side-folding guides 1, 1, and the driving unit of the up-folding guides 4, 4 in order by manually operating the wrapping start switch S2, and at the same time operates the driving unit of the tape applying mechanism 11 and the driving unit of the sheet feed mechanism 12 in order.

Figure 6:
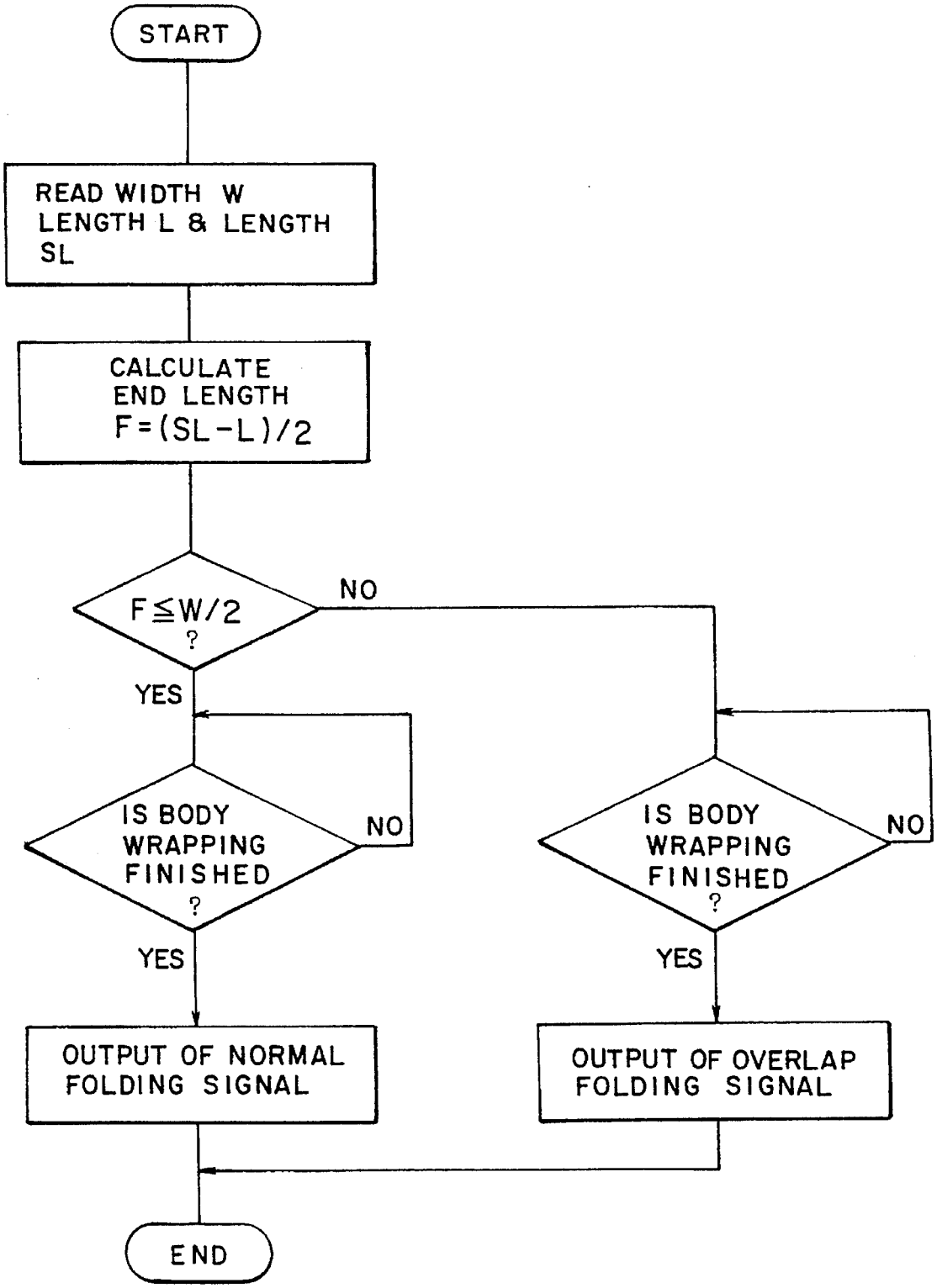
FIG. 6 is a flowchart.

The program stored in the ROM is partly shown in a flowchart in FIG. 6, with reference to which a process for discriminating the normal folding and the overlap folding will be explained.

When the program is started, the microcomputer 10*b* first reads the width W and length L of the open sides B1, B1 of the content B and the length SL of the wrapping sheet A from the input means 9, and then a remainder after subtraction of the length L of the content B from the length SL of the wrapping sheet A is divided by 2, to thereby determine an overhang length F of each overhang end A1 extruding from the open sides B1, B1 of the content B.

Next, a decision is made to see whether this computation result is smaller than a half of the width W of each open side B1 of the content B. When the overhang length F of each overhang end A1 is greater than a half of the width W of each side B1, the compression plates 13, 13 are pulled out from the content B the body of which has been wrapped with the wrapping sheet A, thus ending the body wrapping process. Immediately after the completion of the body wrapping process, an overlap-folding signal is outputted to the driving unit of the elevator 2, the driving unit of the upstream side-folding guides 1, 1, and the driving unit of the up-folding guides 4, 4, ending the program.

When the overhang length F of each overhang end A1 is equal to, or less than, the width W of each side B1, the compression plates 13, 13 are drawn out from the content B the body of which has been wrapped with the wrapping sheet A, ending the body wrapping process. Immediately after the completion of the body wrapping process, a normal-folding signal is outputted to each of the driving unit of the elevator 2, the driving unit of the upstream side-folding guides 1, 1, and the driving unit of the up-folding guides 4, 4, thus finishing the program.

The wrapping changeover switch S3 is used to select the so-called down-folding wrapping or up-folding wrapping as follows: first, the lower flaps A3, A3 are folded up and then the upper flaps A4, A4 are folded down; when the overhang length of the upper flaps A4, A4 overlapped on the outermost side is greater than the height of the content B, the so-called down-folding wrapping for folding the forward end of the upper flaps A4, A4 along the bottom surface B5 of the content B is selected; on the other hand, first the upper f1laps A4, A4 are folded down and then the lower flaps A3, A3 are folded up; when the overhang length of the lower flaps A3, A3 overlapped on the outermost side exceeds the height of the content B, the so-called up-folding wrapping is selected for folding the forward end of the lower flaps A3, A3 along the upper surface B4 of the content B. Correspondingly to this selection, the control circuit 10 automatically changes the operation of the driving unit of the tape applying mechanism 11, the sheet feed mechanism 12, the driving unit of the elevator 2, and the driving unit of the folding guides 5, 5.

That is, in the down-folding wrapping, the tape applying mechanism 11 is used to affix the adhesive tapes C2, C2 in positions corresponding to the forward ends of the upper flaps A4, A4 of the wrapping sheet wrapped on the body of the content B simultaneously with the application of the adhesive tape C1 which is a special tape for sealing the wrapped body. Then, the down-folding guides 6, 6 are removed or moved out of the transfer path 3b. The folding guides 5, 5 will not be allowed to protrude out even if the upper surface B4 of the content B has come up to the same level as the lower surface of the folding guides 5, 5 with the rise of the elevator 2.

In the up-folding wrapping, the tape applying mechanism 11 is operated to attach the special adhesive tape C1 for sealing the wrapped body, and then to attach the adhesive tapes C2, C2 in positions corresponding to the forward ends of the lower flaps A3, A3 of the wrapping sheet A fed out to a specific length and wrapped around the body. Then, the down-folding guides 6, 6 are installed in, or moved into, the transfer path 3*b* and at the same time the elevator 2 is raised until the upper surface B4 of the content B is at the same level as the lower surface of the folding guides 5, 5. When the elevator 2 has stopped at this level, the folding guides 5,5 are protruded.

Next, the operation of the flap folding device of the wrapping machine will be explained.

Figure 7:
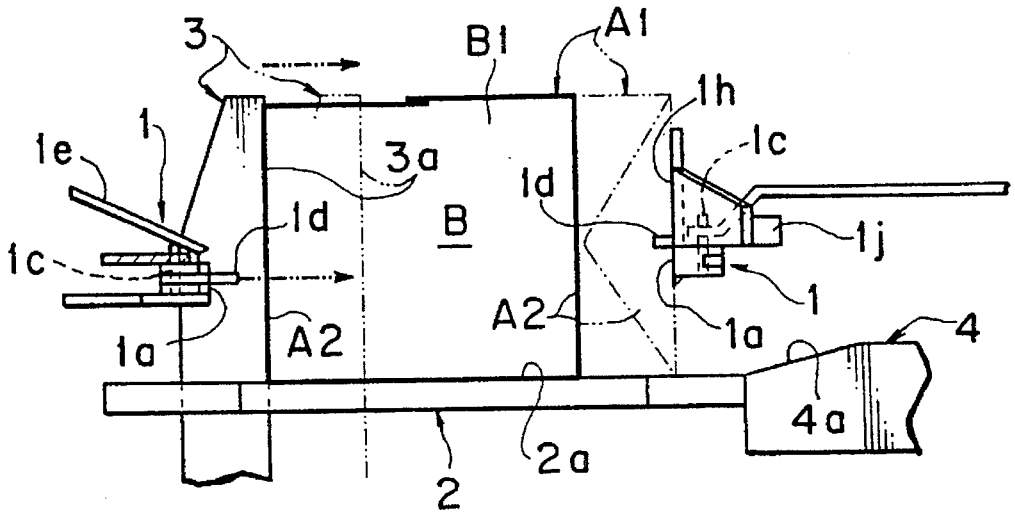
FIG. 7 is a partly cutaway front view showing a partly enlarged side flap at the start of folding.

First, the wrapping changeover switch S3 is operated to select the down-folding wrapping. In this case, the sheet feed start switch S1 is operated to supply the wrapping sheet A. Then, upon finishing the body wrapping process by operating the sheet feed start switch S1, particularly in the case of the so-called overlap folding that the overhang length of each overhang end A1 is greater than a half of the width of each open side B1, the elevator 2 is operated to adjust the level of the content B up and down as shown in FIG. 7 so that the middle position in the vertical direction of the side flaps A2 faces the side-folding guides 3 and accordingly the inclined sides 4*a*, 4*a* of the up-folding guides 4, 4 will be slightly higher than the mounting surface 2*a* after the adjustment.

Figure 8:
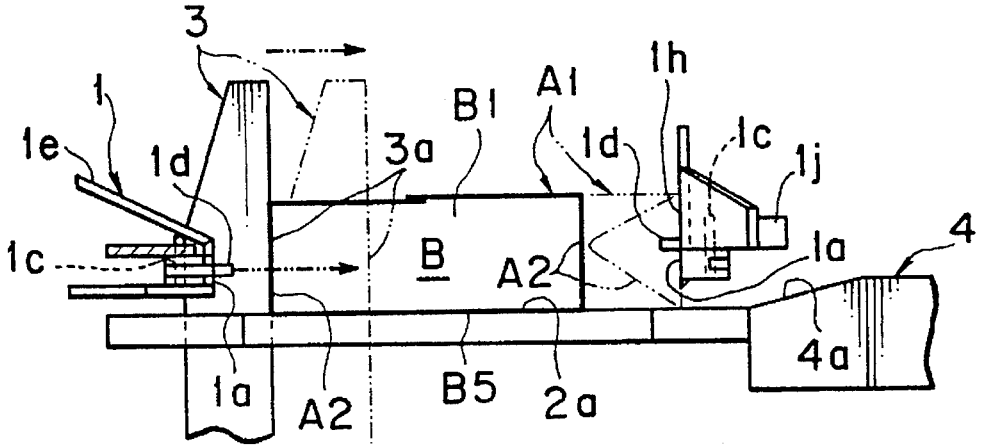
FIG. 8 is a partly cutaway front view showing an overhang end in the case of long overhang.

Also, in the case of the so-called normal folding that the overhang length of each overhang end A1 is less than a half of the width of each open side B1, the elevator 2 is operated to adjust the level of the content B so that, as shown in FIG. 8, the bottom surface B5 faces close to the lower end of the side-folding guide 3, and accordingly the inclined sides 4*a*, 4*a* of the up-folding guides 4, 4 are slightly higher than the mounting surface 2*a* after adjustment.

In this state the transfer means 3 moves forward to move the content B along the mounting surface 2*a* of the elevator 2, thereby hitting the downstream closed side B2 nearly simultaneously against the hitting parts 1*a*, 1*a* of the downstream side-folding guides 1, 1 and the fixed upright surfaces 1*h*, 1*h* and accordingly pressing the wrapped body parts A7, A7 near the base end of the downstream side flaps A2, A2 facing the downstream closed side B2 against the downstream closed side B2.

At this point of time, the forward movement of the transfer means 3 temporarily stops and the content B is unmovably positioned between the vertical pushing surface 3*a* and the hitting parts 1*a*, 1*a* temporarily held by temporary holders 1*j*, 1*j* and the fixed upright surfaces 1*h*, 1*h*. If the content B is off its mounting position toward the extension line of the open sides B1, B1, the position is properly corrected. At the same time, when the content B is a stack of many sheets of paper or books, the paper and books will be properly arranged.

At the same time, the downstream side flaps A2, A2 are brought to hit against the directing plates 1*d*, 1*d* of the folding parts 1*b*, 1*b*, especially preventing the lower flaps A3, A3 from crushing even when the content B is low as shown in FIG. 11.

Subsequently, the upstream side-folding guides 1, 1 move forward to hit against the hitting parts 1*a*, 1*a*, which in turn strike the upstream closed side B2 of the unmovable content B the body of which has been wrapped as shown by a full line in FIG. 9. Accordingly the wrapped body parts A7, A7 near the base end of the upstream side flaps A2, A2 which face the upstream closed side B2 are pressed against the upstream closed side B2.

At the same time, the directing plates 1*d*, 1*d* of the folding parts 1*b*, 1*b* hit against the upstream side flaps A2, A2 to direct the side flaps A2, A2 in a vertical direction, thus preventing the lower flaps A3, A3 from crushing particularly if the height of the content B is low as shown in FIG. 11.

Next, the intermedium part of the inner surface of the upstream side-folding guides 1, 1 which are moving forward, as shown by an alternate long and two short dashes line in FIG. 9, makes a quarter turn while tracing the corners B3, B3 of the upstream side B2 and the open sides B1, B1, and accordingly the folding parts 1*b*, 1*b* move downward toward the lower flaps A3, A3, thereby pulling the whole body of the upstream side flaps A2, A2 downward. Therefore the upper part of the base end of the side flaps A2 is folded tight along the open sides B1, B1 of the content B while being pressed against the corners B3, B3. At the same time, when the mounting position of the content B is shifted in the lateral direction, that is, the direction of extension lines of the closed sides B2, B2, the upstream side-folding guides 1, 1 rotate to correct the position.

At this time, especially in the case of the overlap folding that the overhang length of each overhang end A1 is greater than a half of the width of each open side B1, both the folding parts 1*b*, 1*b* and the movable upright surfaces 1*e*, 1*e* which gradually rise upright contact a nearly middle position in the vertical direction of the side flaps A2 that have been folded as indicated by an alternate long and two dashes line in FIG. 10, thereby scooping the upstream side flaps A2, A2 upward from below to fold the side flaps A2, A2, and, at the same time, obliquely folding the lower flaps A3, A3 along the folding lines A3', A3' and the upper flaps A4, A4 along the folding lines A4', A4'.

Furthermore, in the case of the so-called normal folding that the overhang length of each overhang end A1 is less than a half of the width of each open side B1, the lower end of these folding parts 1*b*, 1*b* lowers to the vicinity of the bottom surface B5 of the content B as indicated by an alternate long and two short dashes line in FIG. 11, and the pressing surfaces 1*f*, if hold the swelling on the upstream side of the lower flaps A3, A3, producing a horizontal folding line. At the same time, when the content B is low and the upper end of the movable upright surfaces 1*e*, 1*e* which rise upright from the upper surface B4 is high, the upstream side of the upper flaps A4, A4 are folded up simultaneously with the folding of the upstream side flaps A2, A2.

Thereafter, the transfer means 3 moves forward to transfer the content B again, and the downstream side-folding guides 1, 1 are released from the temporary holders 1*j*, 1*j* as shown in FIG. 12; the downstream side-folding guides 1, 1 make a quarter turn while the middle part of the inner surface traces the corners B3, B3 between the downstream side B2 and the open sides B1, B1, thus pulling the whole body of the downstream side flaps A2, A2 downward to fold these side flaps tight while the upper part of the base end of the side flaps A2, A2 is pressed against the corners B3, B3. At the same time, when the transfer position of the content B shifts in the lateral direction, the downstream side-folding guides 1, 1 are rotated to correct the positional shift.

At the same time, the downstream side flaps A2, A2 are scooped upward from below with the upward inclined sides 1*h*', 1*h*' of the fixed upright surfaces 1*h*, 1*h* as shown in FIG. 13. When the content B is high and the upper end of the fixed upright surfaces 1*h*, 1*h* rising upright from the upper surface B4 thereof is low, only the downstream side flaps A2, A2 will be folded.

Particularly in the case of the so-called overlap folding that the overhang length of each overhang end A1 is greater than a half of the width of each open side B1, the forward end of the middle part in the vertical direction of the folded upstream side flaps A2, A2 is overlapped with the outside of the forward end of the middle part in the vertical direction of the folded upstream side flaps A2, A2 when the content B is carried by the transfer means 3 while the upstream side-folding guides 1, 1 are stopped in the folding position; at the same time, the lower flaps A3, A3 are folded obliquely along the folding lines A3', A3' and the upper flaps A4, A4 along the folding lines A4', A4', thus being folded each into a trapezoidal form and projecting out in the lateral direction.

Furthermore, in the case of the so-called normal folding that the overhang length of each overhang end A1 is less than a half of the width of each open side B1, the lower end of the folding parts 1*b*, 1*b* lowers as low as the bottom surface B5 of the content B as shown in FIG. 14. Also when the content B is low and the upper end of the fixed upright surfaces 1*h*, 1*h* is higher than its upper surface B4, the downstream side flaps A2, A2 are folded and at the same time the downstream upper flaps A4, A4 are folded up. Then, as the content B is transferred by the transfer means 3, a horizontal folding line is produced at the downstream base end of the lower flaps A3, A3 by the projections 1*i*, 1*i* having an acute-angle section.

Thereafter, the content B passes through between the inner surfaces of the side-folding guides 3 that have rotated as indicated by an alternate long and two dashes line in FIG. 12, being guides to a laterally short downstream side of the mounting surface 2*a*. In the vicinity of the right and left ends of the bottom surface B5 of the content B protruding from this mounting surface 2*a*, the upper surface of the -hanging-flap receiving bases 2*d*, 2*d* is contiguously supported, to thereby prevent the right and left ends or their vicinity of the bottom surface B5 from drooping.

At the same time, the base end of the lower flaps A3, A3 hit to be folded against the inclined sides 4*a*, 4*a* of the up-folding guides 4, 4 which are slightly higher than the mounting surface 2*a* of the elevator 2, thus preventing the loosening of the side flaps A2 thus folded.

Subsequently, the downstream closed side B2 of the content B that has been transferred by the transfer means 3 hits against the upright piece 8*b* of the latch 8 which is protruded largely, waiting at the upstream end. Then, the upright piece 8*b* being pressed against the downstream closed side B2 is moved downstream until the content B reaches a specific position, thus finishing the forward movement of the transfer means 3.

Figure 18:
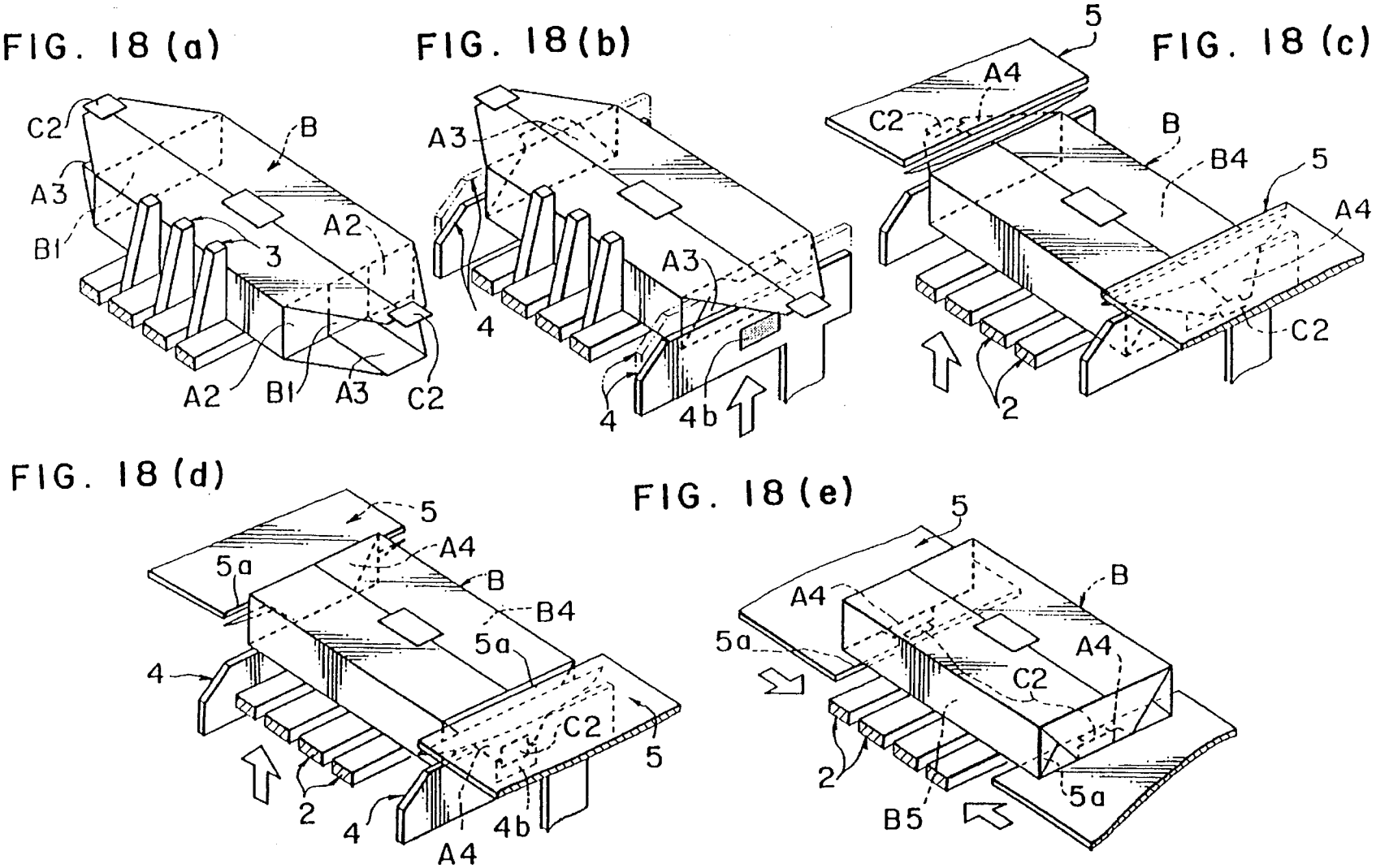
FIGS. 18(*a*)–18(*c*) are perspective views showing the flap folding processes of the down-folding wrapping in order.

Almost at the same time, the upstream side-folding guides 1, 1 contiguously engages with the return projections 1*g*, 1*g* on the way of return as shown in FIG. 15, thereby forcing the upstream side-folding guides 1, 1 to turn back to the initial state. Subsequently, the up-folding guides 4, 4 begin to rise to fold the lower flaps A3, A3 to the outside of the side flaps A2 as shown in FIG. 18(*b*). Particularly when the content B is high, the lower flaps A3, A3 are folded up to the outside of the side flaps A2 held in a folded state by the push rods 11, 11. At the same time, the inclined sides 4*a*, 4*a* contiguously engages with inclined cam faces 1*k*, 1*k* of the downstream side-folding guides 1, 1, forcing the downstream side-folding guides 1, 1 to turn back to return to the initial state as shown in FIG. 15.

At this time, in the case of the so-called overlap folding that the overhang length of each overhang end A1 is greater than a half of the width of each open side B1, the upper ends of the up-folding guides 4, 4 go up to the level where they do not contact the oblique folding lines A4' of the upper flaps A4, A4. Also in the case of the so-called normal folding that the overhang length of each overhang end A1 is less than a half of the width of each open side B1, the upper ends of the up-folding guides 4, 4 rise to the vicinity of the upper surface B4 of the content B, thus ending the up-folding of the lower flaps A3, A3.

Thereafter, the mounting surface 2*a* of the elevator 2 and the hanging-flap receiving bases 2*d*, 2*d* move upward, and the content B, as indicated by a full line in FIGS. 16 and 17 and as shown in FIG. 18(*c*), is pushed upward while being guided by the up-folding guides 4, 4 which have started upward movement after the completion of folding, along the pushing surface 3*a* that has stopped moving forward and the upright piece 8*b* of the latch 8 which protrudes largely. The upper flaps A4, A4 before down folding hit against the angle sections 5g, 5g of the folding guides 5, 5, pushing to spread the upper flaps A4, A4 such that the widthwise center will protrude most downward in the direction of folding, to thereby prevent such troubles as the entangled application of the adhesive tapes C2, C2 that have been affixed on the forward ends of the upper flaps A4, A4 and the occurrence of creases in the upper flaps A4, A4.

And almost at the same time, the upper surface B4 of the content B which is going upward is guided by the inclined surfaces 5f, 5f until the right and left ends of the upper surface B4 hit against the stoppers 5d, 5d, where the stoppers 5d, 5d move away from the inner ends 5a, 5a of the folding guides 5, 5. Consequently the inner ends 5a, 5a of the folding guides 5, 5 are pressed by the weights 5c, 5c under a specific pressure against the open sides B1, B1 of the content B.

Therefore, the upper flaps A4, A4 are gradually folded down while being pressed downward as indicated by an alternate long and two dashes line in FIG. 17 and as shown in FIG. 18(*d*), and simultaneously the adhesive side of the adhesive tapes C2, C2 affixed on the forward end of the upper flaps A4, A4 is attached on engaging parts 4b, 4b such as sponge protrusively installed on the outer surface of the up-folding guides 4, 4.

The content B being carried upward on the elevator 2 and the up-folding guides 4, 4 move away from each other in the vertical direction from this state, pulling the upper flaps A4, A4 downward to overlap with the outside of the lower flaps A3, A3. Then only the content B goes up, and the adhesive tapes C2, C2 on the upper flaps A4, A4 are detached from the engaging parts 4b, 4b. When the length of projection of the upper flaps A4, A4 is less than the height of the content B as shown in FIGS. 1 to 17, the adhesive tapes C2, C2 on the upper flaps A4, A4 while being pulled by the inner ends 5a, 5a of the folding guides 5, 5 are affixed for sealing on the lower flaps A3, A3, thus ending the flap folding process.

When the length of projection of the upper flaps A4, A4 is greater than the height of the content B and accordingly the forward end of the upper flaps A4, A4 folded appears below the bottom surface B5 of the content B, the inner ends 5a, 5a of the folding guides 5, 5 protrude along the bottom surface B5 of the content B at the weights 5c, 5c after the passage of the content B, which is moving upward, through between the inner ends 5a, 5a of the folding guides 5, 5, and accordingly the latches 7 of a little projection protrude along the right and left ends of the bottom surface B5, and furthermore the upright piece 8b of the latch 8 of large projection also protrudes to the vicinity of the center along the bottom surface B5.

After the content B is supported by the latches 7, 8, the mounting surface 2a of the elevator 2 lowers, and the inner ends 5a, 5a of the folding guides 5, 5 protrude at the weights 5c, 5c as shown in FIG. 18(*e*), to thereby fold the forward ends of the upper flaps A4, A4 along the bottom surface B5 of the content B, and at the same time to attach the adhesive tapes C2, C2 applied on these forward ends, to seal the content B, thus ending the flap folding process.

Subsequently, when the wrapping changeover switch $3 is operated to select up-folding wrapping, the adhesive tapes C2, C2 protrude from the forward ends of the lower flaps A3, A3 as shown in FIG. 19(*a*) after the completion of the body wrapping process, and the side flaps A2 are folded inward by the side-folding guides 1; then the transfer means 3 moves forward to move the content B along the mounting surface 2a of the elevator 2, and the upper flaps A4, A4 hit against the down-folding guides 6, 6 as shown in FIG. 19(*b*), being folded along the open sides B1, B1 of the content B.

Thereafter as the content B is carried, the lower flaps A3, A3 hit, at their base ends, against the inclined sides 4a, 4a of the up-folding guides 4, 4 and are folded up. The up-folding guides 4, 4 rise to fold up the lower flaps A3, A3 along the open sides B1, B1 as shown in FIG. 19(*c*), and subsequently the elevator 2 goes upward.

Accordingly, as shown in FIG. 19(*d*), the upper surface B4 of the content B rises to the same level as the lower surface of the folding guides 5, 5, where the elevator 2 temporarily stops rising. Then, the folding guides 5, 5, as shown in FIG. 19(*e*), protrude along the upper surface B4 of the content B, thereby folding the forward end of the lower flaps A3, A3. At the same time the adhesive tapes C2, C2 applied on the forward ends are attached for sealing on the upper surface B4, thus finishing the flap folding process.

After the flap folding of the content B, the wrapping of the following content B is started. The elevator 2 begins descending and the folding guides 5, 5 move away from each other; even in this case, the content B, being supported by the latches 7, 8, will not go downward. When the following content B has been wrapped without removing the preceding content B that has been wrapped, these contents B are stacked on the latches 7.

Furthermore, when the size of the wrapping sheet A has been changed, the control circuit 10 automatically changes the length of the wrapping sheet A to be fed out by the sheet feed mechanism 12, on the basis of data newly entered by the input means 9.

When the outside dimensions including height of the content B have been changed, the control circuit 10 will automatically change the length of the wrapping sheet A to be fed out by the sheet feed mechanism 12, on the basis of data newly inputted by the input means 9, and also will automatically change the amount of ascent and descent of the elevator 2 and the level of the up-folding guides 4, 4; when the width of the content B has been changed, the control circuit 10 will automatically change the length of the wrapping sheet A to be fed out by the sheet feed mechanism 12, moving the reference guides 15 and the body wrapping guides 14, 14 in the same direction to automatically change a distance between these guides. Furthermore, when the length of the content B has been changed, the up-folding guides 4, 4 and the folding guides 5, 5 will be moved in the lateral direction, thus automatically changing the distance between the guides.

In the embodiment previously described, one wrapping sheet A was separated from a pile of wrapping sheets A and fed onto the elevator 2, but it should be noted that the present invention is not limited to the embodiment explained above and a wrapping sheet wound in a form of roll may be cut to a specific length and supplied onto the elevator 2.

Furthermore, the forward ends of the upper flaps A4, A4 or the lower flaps A3, A3 were sealed with the adhesive tapes C2, C2 that had previously been applied, but the present invention is not limited thereto and the adhesive tape may be attached in the course of, or after, the wrapping process, or also may be attached by the use of paste other than the solid adhesive tape by a tape applying mechanism mounted for example on the way of, or after the end of, the wrapping process.

Furthermore, the wrapping sheet A was folded up in a form of U letter for body wrapping along both sides B2, B2 and bottom surface B5 of the content B while moving downward on the elevator 2, but the present invention is not limited thereto and the body wrapping may be performed by hitting the upper surface B4 of the content B against the wrapping sheet A supplied above it, with the ascent of the elevator 2, and then by folding down the wrapping sheet A into a form of inverted U letter along both sides B2, B2 and upper surface B4 of the content B.

And furthermore, the folding parts 1*b* were lowered with the rotation of the side-folding guides 1 by the use of the support shaft 1*c* which forms a spiral guide path as a guide moving means, but the present invention is not limited to the embodiment explained above and the folding parts 1*b* may be moved upward with the rotation of the side-folding guides 1 by the use of the guide moving means especially in the case of the so-called up-folding wrapping that the upper flaps A4, A4 are folded after the folding of the side flaps A2.

The present invention, having the constitution described above, has the following advantages.

1. The side-folding guide approaches the side flap until the hitting part hits against the closed side of the content whose body has been wrapped, to thereby press the wrapped body part near the base end of the side flap facing the closed side against the closed side; subsequently, the middle part of the side-folding guide makes a quarter turn while tracing a corner continued to the closed side. Thus the base end of the side flap is folded along the corner while being pulled toward its forward end, and also is pushed against the open side through the entire length from the base end to forward end of the side flap at the folding part. The side flaps, therefore, can be folded tight without swelling at a body wrapping part near the base end thereof.

Therefore, as compared with the prior-art device in which the side-folding guide simply moves horizontally along the open side of the content to be wrapped, to push to fold the upper and lower ends of the side flap as in a straight state, the present invention has the following advantage that if the body is wrapped loose or if a corner part disposed between the closed side of the wrapped content and the open side is chamfered to an oblique or circular form, stabilized side flap folding can be ensured and the whole part of the overhang end can be folded tight along the side, thus improving the outside appearance as well as its commodity value. In addition, since the side-folding guides rotate in contact with the content to be wrapped, there is no necessity to provide a power source for turning the side-folding guides unlike the prior-art device which required the turning of the side-folding guides. Moreover, when no content is fed in, the side-folding guides will stop without a special changeover operation.

2. The folding part is moved either toward the lower flaps or the upper flaps by the guide moving means when the side-folding guides are rotating, and therefore the whole part of the side flaps is pulled in the elevating direction of the folding part, thus folding the side flaps particularly while pressing the base end of the side flaps located on the reverse side of the elevating direction against the corner. It is, therefore, possible to fold the whole part of the side flap tightly simply by folding one place in the vertical direction of the side flap without regard to the height of the content.

Therefore, as compared with the prior art that the side flap was folded at two places, upper and lower, by means of the side-folding guides, the present invention has the following advantage that even when the height of the content has been changed, it is unnecessary to change the vertical size of the side-folding guides. Since the side-folding guides require no vertical size adjusting mechanism, the whole body of the device can be simplified and minimized in construction.

3. The folding part is moved to either upper or lower end of the content by the guide moving means at the time of rotation of the side-folding guides, to thereby produce a horizontal folding line in either the lower flap or the upper flap disposed in the direction of this movement. It is, therefore, possible to fold the lower or upper flap exactly.

4. The content is transferred in the lateral direction by the transfer means to hit, against the inclined side, the base end of the lower flap or the upper flap disposed in the direction of movement of the guide moving means; with both side flaps being pulled in the direction of movement of the guide moving means, only the base end of the lower flap or the upper flap disposed in this direction of movement is folded, partly producing a folding line between these flaps. Therefore the remaining lower and upper flaps are folded, holding the folded state of the side flaps. When the remaining lower and upper flaps are folded, the whole part of the flap can be folded tight without loosening the side flaps previously folded.

5. The contact-rotation timing of a pair of side-folding guides in relation to both side flaps of each overhang end is shifted with time, the middle part in the vertical direction of both side flaps is folded along the open side of the content, thus overlapping the forward ends of the side flaps; at the same time, the folding of both side ends of the lower and upper flaps is stopped on the way. Therefore even in the case of the so-called overlap folding that the overhang length of each overhang end is greater than a half of the width of the open side, the lower flap and the upper flap can be folded in a trapezoidal form without both side flaps interfering with each other.

Therefore, as compared with prior-art devices which can not perform the so-called overlap folding that the overhang length of each overhang end is greater than a half of the width of the open side, the upper and lower flaps can be folded smoothly without deteriorating the outside appearance. Besides, both side flaps can be folded along the open sides. The flap folding device of the present invention, therefore, insures easy wrapping in a wide range of applications.

6. The hitting part of the two side-folding guides which are waiting on straight lines extending nearly in parallel with the closed side of the content whose body has been wrapped is hit against each closed side simultaneously, thereby correcting the mounting position of the content to the direction of the extension lines of the open side; thereafter, the side-folding guide makes a quarter turn while the middle part of its inner surface is tracing the corner section continued to the closed side, thus passing with its straight inner surface in contact with the parallel open side to thereby correct the mounting position of the content to the direction of the extension lines of the closed side. It is, therefore, possible to properly set the content in the mounting position.

Therefore, as compared with prior-art devices in which each side-folding guide moves horizontally along the parallel open side of the content after hitting against the side flap, the present invention has the advantage that the content will not move out of the mounting position with a shock of hitting of the side-folding guide against the side flap even when the content is light-weight and easy to move. Besides, provided that the content is off the mounting position due to a dimensional error of the content, the positional shift of the content can be absorbed, preventing a defective folding of the side flap. And further, the positional shift of the content can be prevented by changing the side-folding guide to side flap hitting timing.

7. The reversion holding means is operated into contact-engagement with the side-folding guide in the case of a change in a positional relation with the side-folding guide which has turned to the folding direction, thereby forcing the hitting part which is off the content, to turn reversely in the reverse direction of folding of the side flap. As compared with prior-art devices in which the side-folding guide is reversed by means of an elastic member such as a spring, the device of the present invention insures reliable forced reversion of the side-folding guide for a prolonged period of time, without such a trouble as a failure of the elastic member after a long-time use or hitch of the side-folding guide on the flap.

8. The length of projection of each protruding end is computed from the inputted length of the wrapping sheet and the length of the content, and a comparison is made of the result of computation with a half of the width of the open side of the content to decide either normal folding or overlap folding. The operation of the elevating means is controlled in accordance with a result of this decision, thus automatically adjusting the contact position of the side flap and the side-folding guide to the optimum normal- or overlap-folding position. It is, therefore, possible to perform normal folding and overlap folding without adjusting the side-folding guide regardless of a change in size of the content and the wrapping sheet by inputting numerical values.

9. The side flap-to-side-folding guide contact position is automatically adjustable to the optimum normal or overlap folding position by moving by the control means the level of the elevator mounted with the content. It is, therefore, unnecessary to move to adjust the side-folding guide.

Therefore, as compared with prior-art devices which require the movement for adjustment of the side-folding guide when the height of the content has been changed, the present invention requires no side-folding guide adjusting mechanism and accordingly can simplify the construction of the device as well as miniaturize the whole body of the device.

10. The end-of-folding position of the guide for the lower flap or upper flap to be folded subsequently to the side flap is controlled by the control means. That is, the end-of-folding position of the content can be changed according to the normal folding or the overlap folding position thus controlled. In the case of the overlap folding, the lower flap or the upper flap can be folded without the forward end of the guide contacting the folding line of the upper or lower flap.

11. After folding of both side flaps by the side-folding guide, the content is horizontally transferred by the transfer means along the transfer path equipped with no down-folding guide, thereby folding up the lower flap by the up-folding guide. Subsequently, the content is carried upward on the elevator until the upper flap hits against the folding guide. Then the folding guide is projected along the bottom surface of the content, to thereby fold down the upper flap against the outside of the lower flap, while its forward end is folded in against the bottom surface of the content. Thereafter, the content with both side flaps folded in is horizontally transferred along the transfer path equipped with the down-folding guide, thus folding up the upper flap and then folding down the lower flap on the outside of the upper flap by the up-folding guide. And almost simultaneously, the content is brought upward on the elevator, in the course of which the folding guide is protruded along the upper surface of the content to thereby fold the forward end of the lower flap against the upper surface of the content. It is, therefore, possible to perform both down- and up-folding wrapping in one flap folding process.

Therefore, as compared with prior-art devices having only a special machine for either down-folding wrapping or up-folding wrapping, the present invention provides one device capable of selectively performing both down-folding wrapping and up-folding wrapping, improving usability of the device. At the same time, it is possible to fold down one of the overhang ends and fold up the other overhang end. Besides, the whole body of the device can be made small in size as compared with the prior-art device which separately has both the down-folding and up-folding flap folding processes.

What is claimed is:

1. A flap folding device of a wrapping machine, for wrapping a generally rectangular content, having a pair of side-folding guides, a wrapping sheet having first and second ends comprising overhanging ends and a pair of side flaps, said side-folding guides being adapted to move toward, and away from, both of said side flaps at each of said overhanging ends of said wrapping sheet, said wrapping sheet protruding in a substantially square cylindrical form from an open side of said generally rectangular content, a body of said content being wrapped in a substantially tubular form with said wrapping sheet, said side-folding guides being arranged on the same plane as said open side, said flap folding device being adapted for folding a lower flap and an upper flap of said wrapping sheet in sequential order, at each of said first and second ends along said open side of said content after folding both of said side flaps inwardly along said open side of said content, said flap folding device comprising:

elevating means for elevating at least one of said content and said side-folding guides, to change a hitting position between said side flaps and said side-folding guides;

input means for inputting the width of the open side of said content and the length of said content intersecting said width as well as the length of said wrapping sheet;

computing means for computing the overhanging length of each of said overhanging ends of said wrapping sheet on the basis of data outputted from said input means;

comparing means for comparing the output of said computing means with one half of the width of said open side; and control means for controlling the operation of a guide moving means in accordance with the output of said computing means.

2. The flap folding device of claim 1, wherein said elevating means comprises an elevator loaded with a content, with the body of said content being wrapped with said wrapping sheet; the level of said elevator being controlled by said control means; and said side-folding guides being so disposed so as to be unadjustable in a vertical direction.

3. The flap folding device of claim 2, wherein one of a lower and an upper flap guides, for folding one of said lower and upper flaps subsequently to side flap folding, is so disposed so as to be able to reciprocate in a vertical direction along said open side of said content; the level of said elevator being controlled by said control means; and, at the same time, an end-of-folding position of said side folding guides being controlled by said control means.

4. The flap folding device of claim 1, wherein said elevating means shifts a contact rotation timing between said pair of side folding guides and both of said side flaps of each overhanging end with time.

5. A flap folding device of a wrapping machine, for wrapping a generally rectangular content, having a pair of side-folding guides, a wrapping sheet having first and second ends comprising overhanging ends and a pair of side flaps, said side-folding guides being adapted to move toward, and away from, both of said side flaps at each of said overhanging ends of said wrapping sheet, said wrapping sheet protruding in a substantially square cylindrical form from an open side of said generally rectangular content, a body of said content being wrapped in a substantially tubular form, with said wrapping sheet, said side-folding guides being arranged on the same plane as said open side, said flap folding device being adapted for folding a lower flap and an upper flap of said wrapping sheet in sequential order, at each of said first and second ends along said open side of said content, after folding both of said side flaps inwardly along said open side of said content said flap folding device comprising:

a hitting part, adapted to rotatably support a middle position of each of said side-folding guides in a direction of side-flap folding, the center of the rotation being disposed close to the outside of said open side of said content so that said side-folding guides, with said side flaps folded, move into contact with said open side of said content, and face a closed side of said wrapped body of said content, not in contact with said content, at one end of said side-folding guides; and a folding part formed oppositely to said flaps, without contacting content, and on the other end of said side-folding guides.

6. The flap folding device of claim 5, wherein said side-folding guides are disposed oppositely between upper and lower ends of said content, said flap folding device further including guide moving means for moving said folding part toward either one of said lower flap and said upper flap, with the rotation of said side-folding guides, toward folding said side flaps.

7. The flap folding device of claim 6, wherein said guide moving means moves said folding part toward said lower flap.

8. The flap folding device of in claim 7, further including up-folding means, for folding upward along said open side of said content at the time of said side flap folding, said up-folding means being connected to said side-folding guides.

9. The flap folding device of claim 8, wherein, with the rotation of said up-folding means toward side flap folding, an inclined movable upright surface, connected above said folding part, is gradually raised upright so that said inclined movable upright surface, connected above said folding part, contacts said open side of said content from below.

10. The flap folding device of claim 6, wherein said guide moving means moves said folding part as far as one of the upper and lower ends of said content.

11. The flap folding device of claim 10, further including transfer means for transversely transferring said content with said side flaps folded; and inclined sides, slightly inclined toward the center, in the vertical direction of said open sides as they move downstream in the direction of transfer; said inclined sides being disposed so as to be slightly protruding from a transfer surface of said content toward the center in the vertical direction of said open side of said content.

12. The flap folding device of claim 5, wherein a pair of side folding guides is disposed oppositely to a middle position in the vertical direction of said content, and a contact rotation timing between said side folding guides and both of said side flaps, at said overhang ends, has been shifted with time.

13. The flap folding device of claim 5, including four side folding guides located oppositely to said side flaps on said overhang ends, protruding from parallel open sides of said content; said side folding guides being disposed on two straight lines which are substantially parallel with a closed side of said wrapped body in such a manner that said side folding guides are not in contact with said content; with said hitting parts of two of said side folding guides being disposed on straight lines and each closed side of said wrapped body of said content simultaneously hitting against each other.

14. The flap folding device of claim 5, further including reversion holding means for turning said hitting part in a reverse direction of side flap folding and for holding said hitting part, out of contact with said content, against said closed side of said wrapped body; said reversion holding means being operated by contact-engagement caused by a change in a positional relation with said side folding guides that have turned to the folding direction.

15. A flap folding device of a wrapping machine, for wrapping a generally rectangular content, having a pair of side-folding guides, a wrapping sheet having first and second ends comprising overhanging ends and a pair of side flaps, said side-folding guides being adapted to move toward, and away from both of said side flaps at each of said overhang ends of said wrapping sheet, said wrapping sheet protruding in a substantially square cylindrical form from an open side of said generally rectangular content, a body of said content being wrapped in a substantially tubular form with said wrapping sheet, said side-folding guides being arranged on the same plane as said open side, said flap folding device being adapted for folding a lower flap and an upper flap of said wrapping sheet in sequential order, at each of said first and second ends along said open side of said content after folding both of said side flaps inwardly along said open side of said content, said flap folding device comprising:

transfer means adapted to horizontally transfer said content, with the body of said content having previously been wrapped, along the upper surface of an elevator, said elevator being in a lowered position;

side-folding guides, said side-folding guides hitting against both of said side flaps at each of said overhanging ends on a transfer path, thereby folding said side flaps inwardly along said open side of said content;

up-folding guides, said up-folding guides hitting against a lower flap and folding said lower flap upwardly along said open side;

folding guides disposed above said up-folding guides, while contacting said open side of said content as said content is being raised by said elevator, such that said folding guides can protrude out along one of the bottom and upper surfaces of said content; and down-folding guides disposed between said side-folding guides and said up-folding guides, said down-folding guides hitting against an upper flap and folding said upper flat down along said open side such that said down-folding guides can be one of moved out of said transfer path and can reciprocate.

* * * * *